US008529021B2

(12) United States Patent
Baumer et al.

(10) Patent No.: US 8,529,021 B2
(45) Date of Patent: Sep. 10, 2013

(54) CONTINUOUS LIQUID EJECTION USING COMPLIANT MEMBRANE TRANSDUCER

(75) Inventors: Michael F. Baumer, Dayton, OH (US); James D. Huffman, Pittsford, NY (US); Hrishikesh V. Panchawagh, Rochester, NY (US); Jeremy M. Grace, Penfield, NY (US); Yonglin Xie, Pittsford, NY (US); Qing Yang, Pittsford, NY (US); David P. Trauernicht, Rochester, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 234 days.

(21) Appl. No.: 13/089,594

(22) Filed: Apr. 19, 2011

(65) Prior Publication Data

US 2012/0268529 A1 Oct. 25, 2012

(51) Int. Cl.
*B41J 2/04* (2006.01)

(52) U.S. Cl.
USPC ..... 347/54; 347/65; 347/89

(58) Field of Classification Search
USPC ..... 347/20, 44, 47, 54, 56, 61–65, 67, 347/68, 70, 71, 84–87, 89
See application file for complete search history.

(56) References Cited

U.S. PATENT DOCUMENTS 4,245,226 A 1/1981 Paranjpe et al.
6,273,559 B1 8/2001 Vago et al.
6,464,347 B2 10/2002 Kneezel et al.
6,474,787 B1 * 11/2002 Cruz-Uribe ..... 347/54
6,491,362 B1 12/2002 Jeanmaire
6,497,510 B1 12/2002 Delametter et al.
6,554,410 B2 4/2003 Jeanmaire et al.
6,561,627 B2 5/2003 Jarrold et al.
6,575,566 B1 6/2003 Jeanmaire et al.
6,578,955 B2 6/2003 Furlani et al.
6,588,888 B2 7/2003 Jeanmaire et al.
6,793,328 B2 9/2004 Jeanmaire
6,851,796 B2 2/2005 Jeanmaire et al.
7,073,890 B2 * 7/2006 Cabal et al. ..... 347/54
7,273,270 B2 9/2007 Katerberg
7,364,277 B2 4/2008 Chwalek et al.
7,571,992 B2 8/2009 Jia et al.
7,673,976 B2 3/2010 Piatt et al.
2003/0007039 A1 1/2003 Lebens et al.
2003/0112302 A1 6/2003 Furlani et al.

* cited by examiner

*Primary Examiner* — Juanita D Jackson
(74) *Attorney, Agent, or Firm* — Kevin E. Spaulding

(57) ABSTRACT

A method of continuously ejecting liquid includes providing a liquid ejection system that includes a substrate and an orifice plate affixed to the substrate. Portions of the substrate define a liquid chamber. The orifice plate includes a MEMS transducing member that extends over at least a portion of the liquid chamber. A compliant membrane is positioned in contact with the MEMS transducing member. The compliant membrane includes an orifice. Liquid is provided under a pressure sufficient to eject a continuous jet of the liquid through the orifice located in the compliant membrane of the orifice plate by a liquid supply. A drop of liquid is caused to break off from the liquid jet by selectively actuating the MEMS transducing member which causes a portion of the compliant membrane to be displaced relative to the liquid chamber.

19 Claims, 39 Drawing Sheets

CONTINUOUS LIQUID EJECTION USING COMPLIANT MEMBRANE TRANSDUCER

Reference is made to commonly-assigned, U.S. patent applications Ser. No. 13/089,541, titled "MEMS COMPOSITE TRANSDUCER INCLUDING COMPLIANT MEMBRANE", Ser. No. 13/089,523, now U.S. Pat. No. 8,409.900, entitled "FABRICATING MEMS COMPOSITE TRANSDUCER INCLUDING COMPLIANT MEMBRANE ", Ser. No. 13/089,521, now U.S. Pat. No. 8,398,210, entitled "CONTINUOUS EJECTION SYSTEM INCLUDING COMPLIANT MEMBRANE TRANSDUCER", all filed concurrently herewith.

FIELD OF THE INVENTION

This invention relates generally to the field of digitally controlled liquid ejection systems, and in particular to continuous liquid ejection systems in which a liquid stream breaks into drops at least some of which are deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Micro-Electro-Mechanical Systems (or MEMS) devices are becoming increasingly prevalent as low-cost, compact devices having a wide range of applications. Uses include pressure sensors, accelerometers, gyroscopes, microphones, digital mirror displays, microfluidic devices, biosensors, chemical sensors, and others.

MEMS transducers include both actuators and sensors. In other words they typically convert an electrical signal into a motion, or they convert a motion into an electrical signal. They are typically made using standard thin film and semiconductor processing methods. As new designs, methods and materials are developed, the range of usages and capabilities of MEMS devices can be extended.

MEMS transducers are typically characterized as being anchored to a substrate and extending over a cavity in the substrate. Three general types of such transducers include a) a cantilevered beam having a first end anchored and a second end cantilevered over the cavity; b) a doubly anchored beam having both ends anchored to the substrate on opposite sides of the cavity; and c) a clamped sheet that is anchored around the periphery of the cavity. Type c) is more commonly called a clamped membrane, but the word membrane will be used in a different sense herein, so the term clamped sheet is used to avoid confusion.

Sensors and actuators can be used to sense or provide a displacement or a vibration. For example, the amount of deflection δ of the end of a cantilever in response to a stress a is given by Stoney's formula $$\delta=3\sigma(1-\nu)L^2/Et^2 \quad (1),$$

where ν is Poisson's ratio, E is Young's modulus, L is the beam length, and t is the thickness of the cantilevered beam. In order to increase the amount of deflection for a cantilevered beam, one can use a longer beam length, a smaller thickness, a higher stress, a lower Poisson's ratio, or a lower Young's modulus. The resonant frequency of vibration of an undamped cantilevered beam is given by $$f=\omega_0/2\pi=(k/m)^{1/2}/2\pi \quad (2),$$

where k is the spring constant and m is the mass. For a cantilevered beam of constant width w, the spring constant k is given by $$k=Ewt^3/4L^3 \quad (3).$$

It can be shown that the dynamic mass m of an oscillating cantilevered beam is approximately one quarter of the actual mass of ρwtL (ρ being the density of the beam material), so that within a few percent, the resonant frequency of vibration of an undamped cantilevered beam is approximately $$f\sim(t/2\pi L^2)\,(E/\rho)^{1/2} \quad (4).$$

For a lower resonant frequency one can use a smaller Young's modulus, a smaller thickness, a longer length, or a larger density. A doubly anchored beam typically has a lower amount of deflection and a higher resonant frequency than a cantilevered beam having comparable geometry and materials. A clamped sheet typically has an even lower amount of deflection and an even higher resonant frequency.

Based on material properties and geometries commonly used for MEMS transducers the amount of deflection can be limited, as can the frequency range, so that some types of desired usages are either not available or do not operate with a preferred degree of energy efficiency, spatial compactness, or reliability. For example, using typical thin film transducer materials for an undamped cantilevered beam of constant width, Equation 4 indicates that a resonant frequency of several megahertz is obtained for a beam having a thickness of 1 to 2 microns and a length of around 20 microns. However, to obtain a resonant frequency of 1 kHz for a beam thickness of about 1 micron, a length of around 750 microns would be required. Not only is this undesirably large, a beam of this length and thickness can be somewhat fragile. In addition, typical MEMS transducers operate independently. For some applications independent operation of MEMS transducers is not able to provide the range of performance desired. Further, typical MEMS transducer designs do not provide a sealed cavity which can be beneficial for some fluidic applications.

Thermal stimulation of liquids, for example, inks, ejected from DOD printing mechanisms or formed by CIJ printing mechanisms is not consistent when one liquid is compared to another liquid. Some liquid properties, for example, stability and surface tension, react differently relative to temperature. As such, liquids are affected differently by thermal stimulation often resulting in inconsistent drop formation which reduces the numbers and types of liquid formulations used with DOD printing mechanisms or CIJ printing mechanisms.

Accordingly, there is an ongoing need to provide liquid ejection mechanisms and ejection methods that improve the reliability or consistency of drop formation on a liquid by liquid basis while maintaining individual nozzle control of the mechanism in order to increase the numbers and types of liquid formulations used with these mechanisms.

SUMMARY OF THE INVENTION

According to an aspect of the invention, a method of continuously ejecting liquid includes providing a liquid ejection system that includes a substrate and an orifice plate affixed to the substrate. Portions of the substrate define a liquid chamber. The orifice plate includes a MEMS transducing member. A first portion of the MEMS transducing member is anchored to the substrate. A second portion of the MEMS transducing member extends over at least a portion of the liquid chamber. The second portion of the MEMS transducing member is free to move relative to the liquid chamber. A compliant membrane is positioned in contact with the MEMS transducing member. A first portion of the compliant membrane covers the MEMS transducing member and a second portion of the compliant membrane is anchored to the substrate. The compliant membrane includes an orifice. Liquid is provided under a pressure sufficient to eject a continuous jet of the liquid through the orifice located in the compliant membrane of the orifice plate by a liquid supply. A drop of liquid is caused to break off from the liquid jet by selectively actuating the MEMS transducing member which causes a portion of the compliant membrane to be displaced relative to the liquid chamber.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1A:
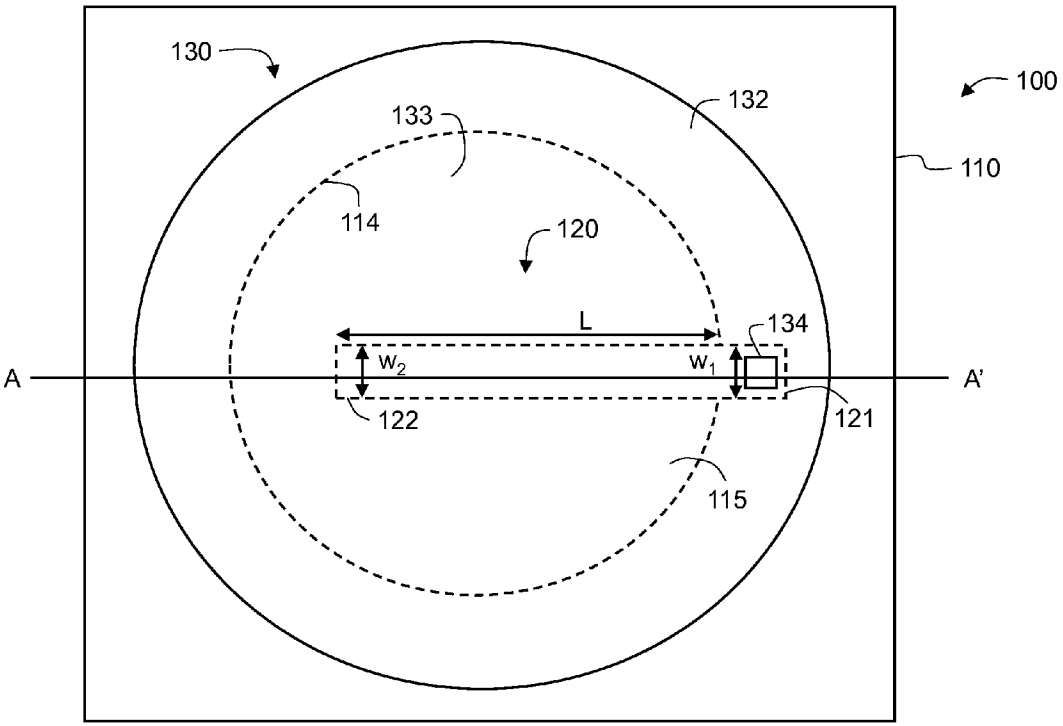
FIG. 1A is a top view and FIG. 1B is a cross-sectional view of an embodiment of a MEMS composite transducer including a cantilevered beam and a compliant membrane over a cavity.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide liquid ejection components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the liquid ejection system or the liquid ejection system components described below.

Embodiments of the present invention include a variety of types of MEMS transducers including a MEMS transducing member and a compliant membrane positioned in contact with the MEMS transducing member. It is to be noted that in some definitions of MEMS structures, MEMS components are specified to be between 1 micron and 100 microns in size. Although such dimensions characterize a number of embodiments, it is contemplated that some embodiments will include dimensions outside that range.

Figure 1B:
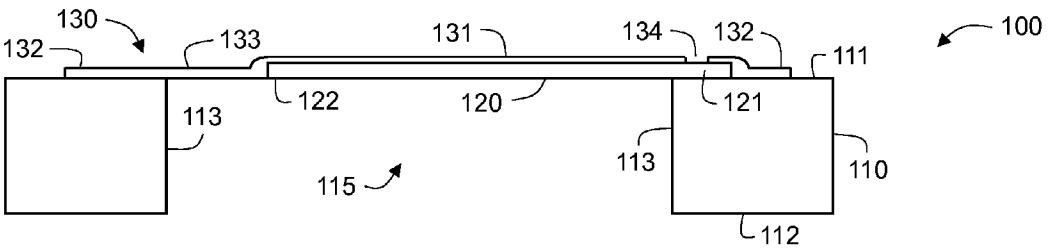

FIG. 1A shows a top view and FIG. 1B shows a cross-sectional view (along A-A') of a first embodiment of a MEMS composite transducer 100, where the MEMS transducing member is a cantilevered beam 120 that is anchored at a first end 121 to a first surface 111 of a substrate 110. Portions 113 of the substrate 110 define an outer boundary 114 of a cavity 115. In the example of FIGS. IA and 1B, the cavity 115 is substantially cylindrical and is a through hole that extends from a first surface 111 of substrate 110 (to which a portion of the MEMS transducing member is anchored) to a second surface 112 that is opposite first surface 111. Other shapes of cavity 115 are contemplated for other embodiments in which the cavity 115 does not extend all the way to the second surface 112. Still other embodiments are contemplated where the cavity shape is not cylindrical with circular symmetry. A portion of cantilevered beam 120 extends over a portion of cavity 115 and terminates at second end 122. The length L of the cantilevered beam extends from the anchored end 121 to the free end 122. Cantilevered beam 120 has a width $w_1$ at first end 121 and a width $w_2$ at second end 122. In the example of FIGS. 1A and 1B, $w_1=w_2$, but in other embodiments described below that is not the case.

MEMS transducers having an anchored beam cantilevering over a cavity are well known. A feature that distinguishes the MEMS composite transducer 100 from conventional devices is a compliant membrane 130 that is positioned in contact with the cantilevered beam 120 (one example of a MEMS transducing member). Compliant membrane includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member near the first end 121 of cantilevered beam 120, so that electrical contact can be made as is discussed in further detail below. In the example shown in FIG. 1B, second portion 132 of compliant membrane 130 that is anchored to substrate 110 is anchored around the outer boundary 114 of cavity 115. In other embodiments, it is contemplated that the second portion 132 would not extend entirely around outer boundary 114.

Figure 2:
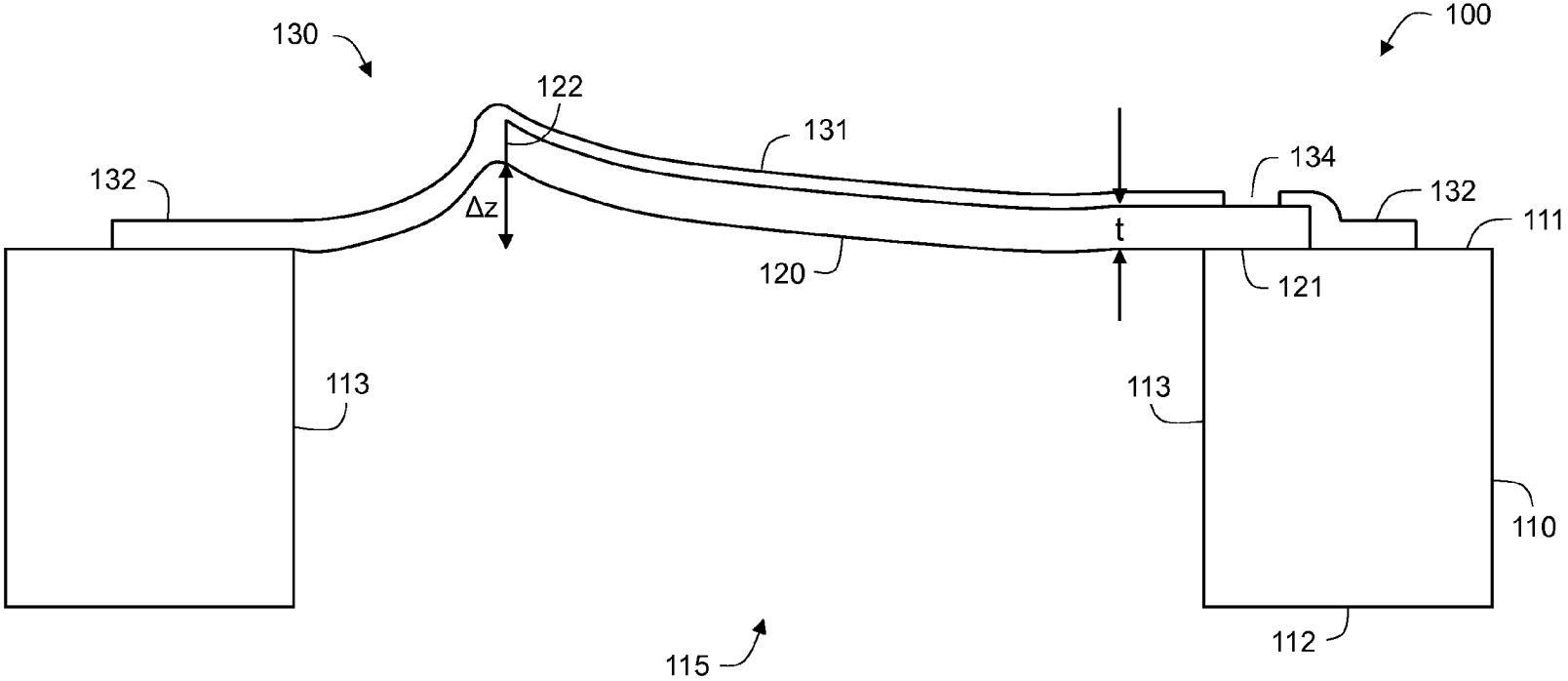
FIG. 2 is a cross-sectional view similar to FIG. 1B, where the cantilevered beam is deflected.

The portion (including end 122) of the cantilevered beam 120 that extends over at least a portion of cavity 115 is free to move relative to cavity 115. A common type of motion for a cantilevered beam is shown in FIG. 2, which is similar to the view of FIG. 1B at higher magnification, but with the cantilevered portion of cantilevered beam 120 deflected upward away by a deflection $\delta=\Delta z$ from the original undeflected position shown in FIG. 1B (the z direction being perpendicular to the x-y plane of the surface 111 of substrate 110). Such a bending motion is provided for example in an actuating mode by a MEMS transducing material (such as a piezoelectric material, or a shape memory alloy, or a thermal bimorph material) that expands or contracts relative to a reference material layer to which it is affixed when an electrical signal is applied, as is discussed in further detail below. When the upward deflection out of the cavity is released (by stopping the electrical signal), the MEMS transducer typically moves from being out of the cavity to into the cavity before it relaxes to its undeflected position. Some types of MEMS transducers have the capability of being driven both into and out of the cavity, and are also freely movable into and out of the cavity.

The compliant membrane 130 is deflected by the MEMS transducer member such as cantilevered beam 120, thereby providing a greater volumetric displacement than is provided by deflecting only cantilevered beam (of conventional devices) that is not in contact with a compliant membrane 130. Desirable properties of compliant membrane 130 are that it have a Young's modulus that is much less than the Young's modulus of typical MEMS transducing materials, a relatively large elongation before breakage, excellent chemical resistance (for compatibility with MEMS manufacturing processes), high electrical resistivity, and good adhesion to the transducer and substrate materials. Some polymers, including some epoxies, are well adapted to be used as a compliant membrane 130. Examples include TMMR liquid resist or TMMF dry film, both being products of Tokyo Ohka Kogyo Co. The Young's modulus of cured TMMR or TMMF is about 2 GPa, as compared to approximately 70 GPa for a silicon oxide, around 100 GPa for a PZT piezoelectric, around 160 GPa for a platinum metal electrode, and around 300 GPa for silicon nitride. Thus the Young's modulus of the typical MEMS transducing member is at least a factor of 10 greater, and more typically more than a factor of 30 greater than that of the compliant membrane 130. A benefit of a low Young's modulus of the compliant membrane is that the design can allow for it to have negligible effect on the amount of deflection for the portion 131 where it covers the MEMS transducing member, but is readily deflected in the portion 133 of compliant membrane 130 that is nearby the MEMS transducing member but not directly contacted by the MEMS transducing member. Furthermore, because the Young's modulus of the compliant membrane 130 is much less than that of the typical MEMS transducing member, it has little effect on the resonant frequency of the MEMS composite transducer 100 if the MEMS transducing member (e.g. cantilevered beam 120) and the compliant membrane 130 have comparable size. However, if the MEMS transducing member is much smaller than the compliant membrane 130, the resonant frequency of the MEMS composite transducer can be significantly lowered. In addition, the elongation before breaking of cured TMMR or TMMF is around 5%, so that it is capable of large deflection without damage.

There are many embodiments within the family of MEMS composite transducers 100 having one or more cantilevered beams 120 as the MEMS transducing member covered by the compliant membrane 130. The different embodiments within this family have different amounts of displacement or different resonant frequencies or different amounts of coupling between multiple cantilevered beams 120 extending over a portion of cavity 115, and thereby are well suited to a variety of applications.

Figure 3:
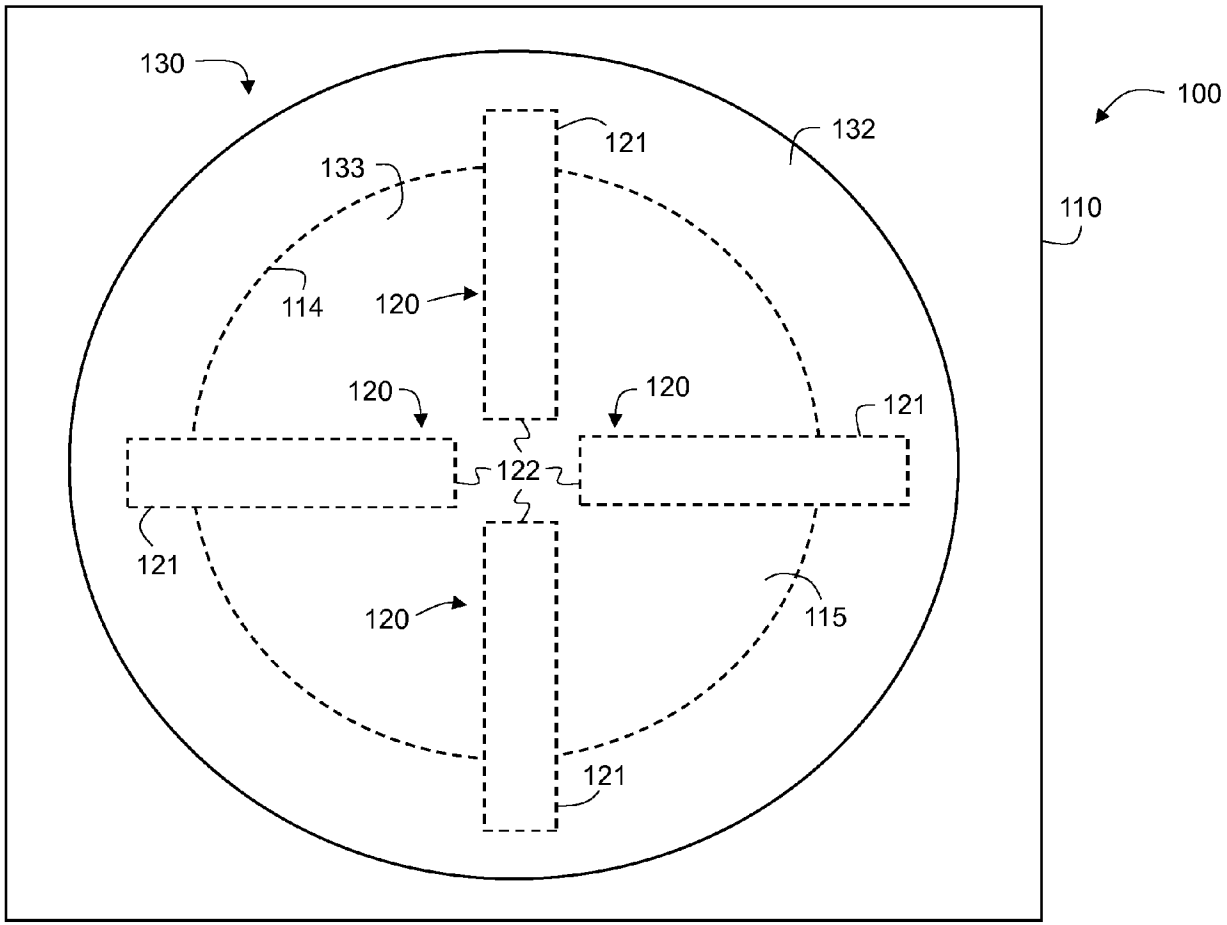
FIG. 3 is a top view of an embodiment similar to FIG. 1A, but with a plurality of cantilevered beams over the cavity.

FIG. 3 shows a top view of a MEMS composite transducer 100 having four cantilevered beams 120 as the MEMS transducing members, each cantilevered beam 120 including a first end that is anchored to substrate 110, and a second end 122 that is cantilevered over cavity 115. For simplicity, some details such as the portions 134 where the compliant membrane is removed are not shown in FIG. 3. In this example, the widths $w_1$ (see FIG. 1A) of the first ends 121 of the cantilevered beams 120 are all substantially equal to each other, and the widths $w_2$ (see FIG. 1A) of the second ends 122 of the cantilevered beams 120 are all substantially equal to each other. In addition, $w_1=w_2$ in the example of FIG. 3. Compliant membrane 130 includes first portions 131 that cover the cantilevered beams 120 (as seen more clearly in FIG. 1B), a second portion 132 that is anchored to substrate 110, and a third portion 133 that overhangs cavity 115 while not contacting the cantilevered beams 120. The compliant member 130 in this example provides some coupling between the different cantilevered beams 120. In addition, for embodiments where the cantilevered beams are actuators, the effect of actuating all four cantilevered beams 120 results in an increased volumetric displacement and a more symmetric displacement of the compliant membrane 130 than the single cantilevered beam 120 shown in FIGS. 1A, 1B and 2.

Figure 4:
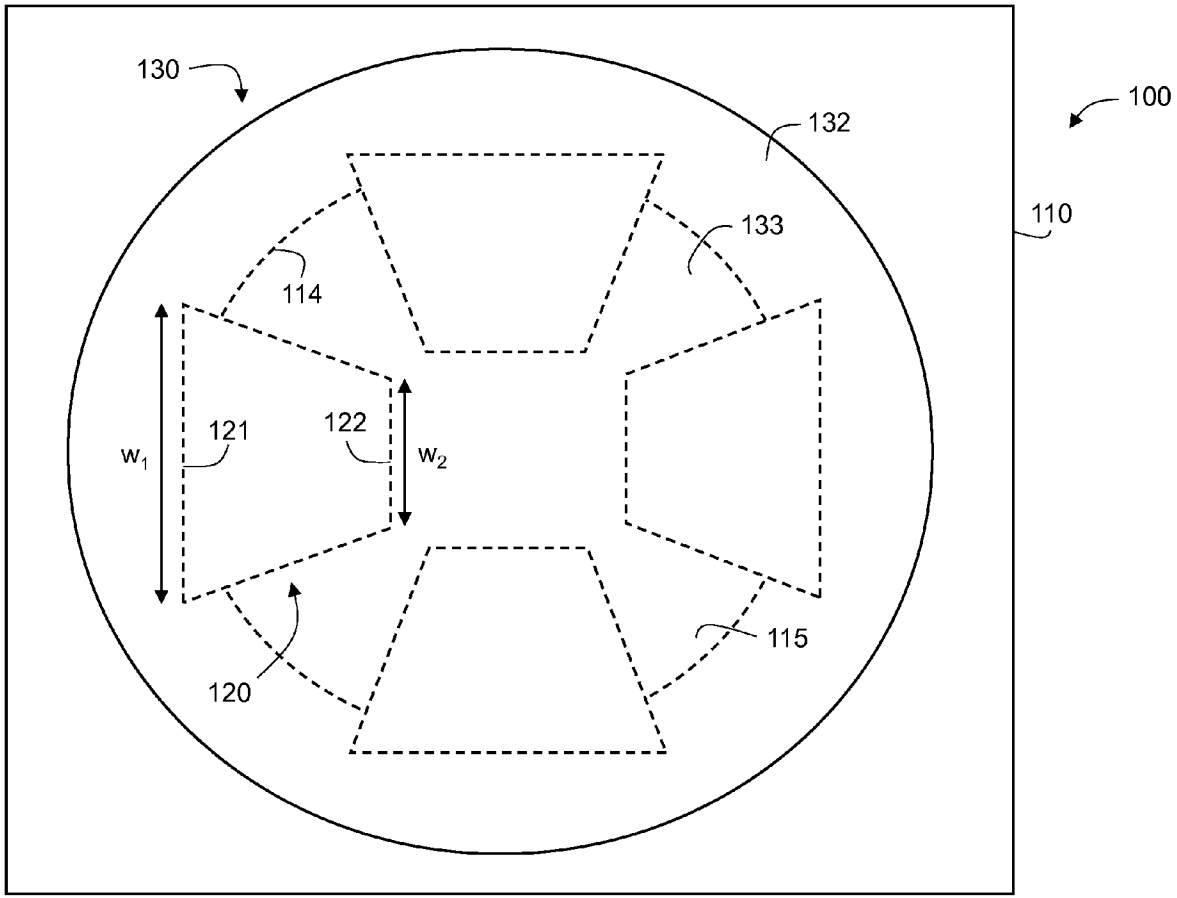
FIG. 4 is a top view of an embodiment similar to FIG. 3, but where the widths of the cantilevered beams are larger at their anchored ends than at their free ends.

FIG. 4 shows an embodiment similar to FIG. 3, but for each of the four cantilevered beams 120, the width $w_1$ at the anchored end 121 is greater than the width $w_2$ at the cantilevered end 122. For embodiments where the cantilevered beams 120 are actuators, the effect of actuating the cantilevered beams of FIG. 4 provides a greater volumetric displacement of compliant membrane 130, because a greater portion of the compliant membrane is directly contacted and supported by cantilevered beams 120. As a result the third portion 133 of compliant membrane 130 that overhangs cavity 115 while not contacting the cantilevered beams 120 is smaller in FIG. 4 than in FIG. 3. This reduces the amount of sag in third portion 133 of compliant membrane 130 between cantilevered beams 120 as the cantilevered beams 120 are deflected.

Figure 5:
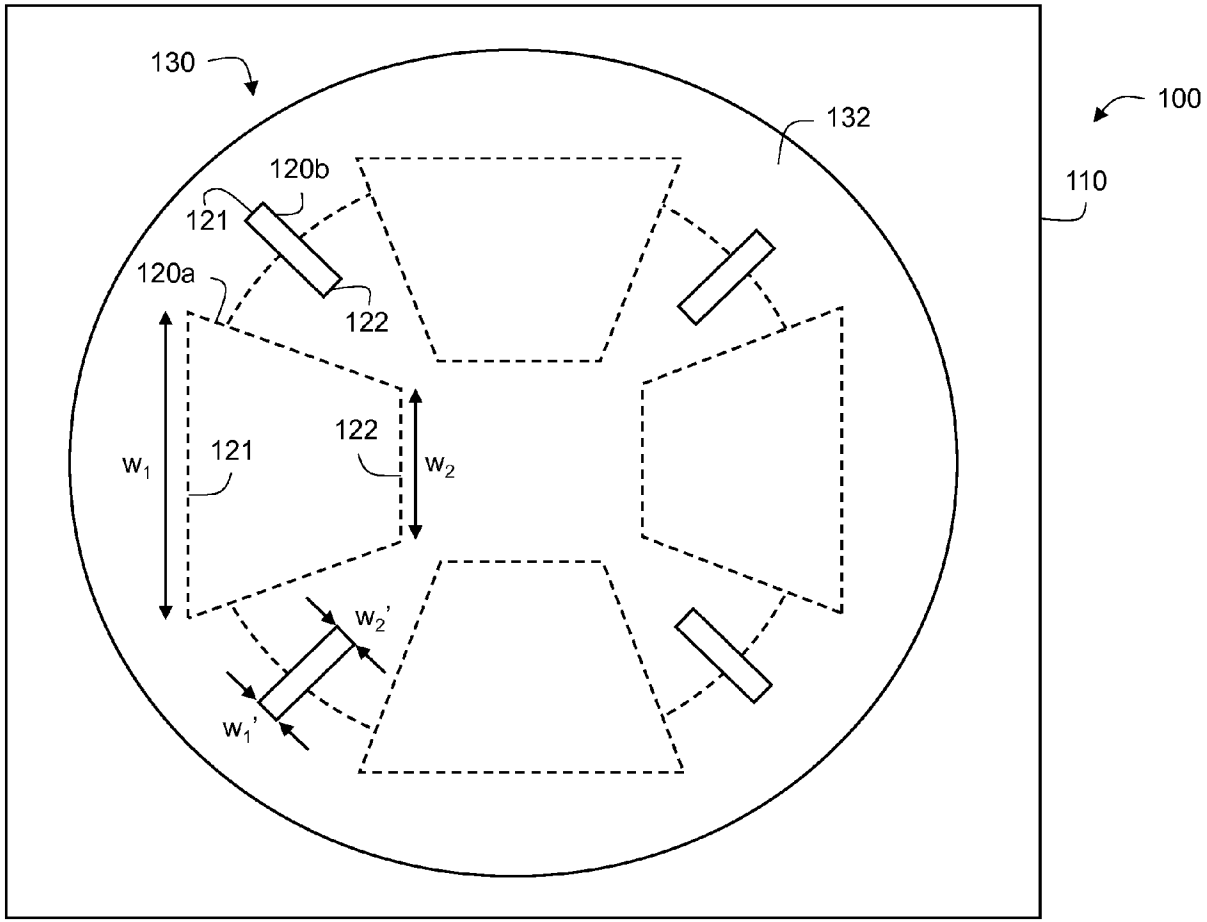
FIG. 5 is a top view of an embodiment similar to FIG. 4, but in addition including a second group of cantilevered beams having a different shape.

FIG. 5 shows an embodiment similar to FIG. 4, where in addition to the group of cantilevered beams 120*a* (one example of a MEMS transducing member) having larger first widths $w_1$ than second widths $w_2$, there is a second group of cantilevered beams 120*b* (alternating arranged between elements of the first group) having first widths $w_1'$ that are equal to second widths $w_2'$. Furthermore, the second group of cantilevered beams 120*b* are sized smaller than the first group of cantilevered beams 120*a*, such that the first widths $w_1'$ are smaller than first widths $w_1$, the second widths $w_2'$ are smaller than second widths $w_2$, and the distances (lengths) between the anchored first end 121 and the free second end 122 are also smaller for the group of cantilevered beams 120*b*. Such an arrangement is beneficial when the first group of cantilevered beams 120*a* are used for actuators and the second group of cantilevered beams 120*b* are used as sensors.

Figure 6:
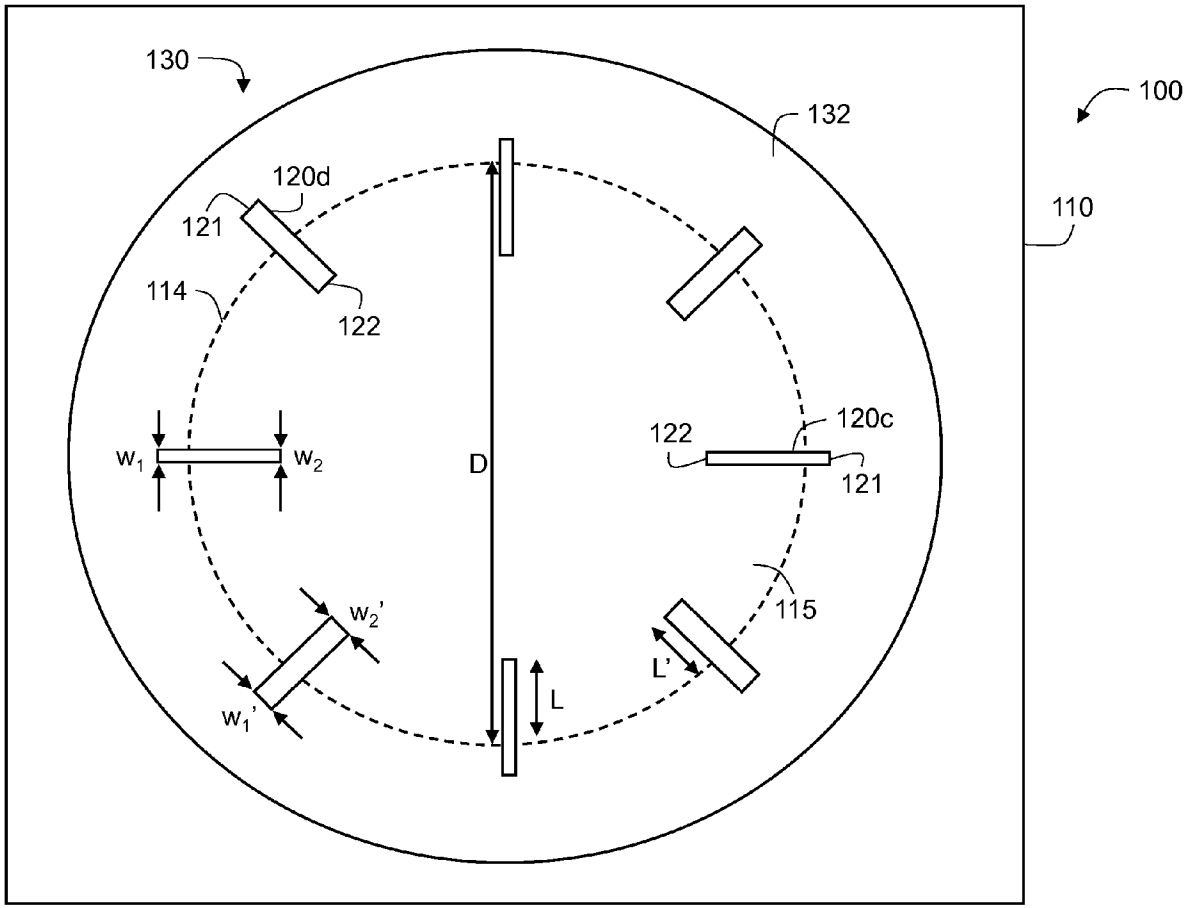
FIG. 6 is a top view of another embodiment including two different groups of cantilevered beams of different shapes.

FIG. 6 shows an embodiment similar to FIG. 5 in which there are two groups of cantilevered beams 120*c* and 120*d*, with the elements of the two groups being alternating arranged. In the embodiment of FIG. 6 however, the lengths L and L' of the cantilevered beams 120*c* and 120*d* respectively (the distances from anchored first ends 121 to free second ends 122) are less than 20% of the dimension D across cavity 115. In this particular example, where the outer boundary 114 of cavity 115 is circular, D is the diameter of the cavity 115. In addition, in the embodiment of FIG. 6, the lengths L and L' are different from each other, the first widths $w_1$ and $w_1'$ are different from each other, and the second widths $w_2$ and $w_2'$ are different from each other for the cantilevered beams 120*c* and 120*d*. Such an embodiment is beneficial when the groups of both geometries of cantilevered beams 120*c* and 120*d* are used to convert a motion of compliant membrane 130 to an electrical signal, and it is desired to pick up different amounts of deflection or at different frequencies (see equations 1, 2 and 3 in the background).

In the embodiments shown in FIGS. 1A and 3-6, the cantilevered beams 120 (one example of a MEMS transducing member) are disposed with substantially radial symmetry around a circular cavity 115. This can be a preferred type of configuration in many embodiments, but other embodiments are contemplated having nonradial symmetry or noncircular cavities. For embodiments including a plurality of MEMS transducing members as shown in FIGS. 3-6, the compliant membrane 130 across cavity 115 provides a degree of coupling between the MEMS transducing members. For example, the actuators discussed above relative to FIGS. 4 and 5 can cooperate to provide a larger combined force and a larger volumetric displacement of compliant membrane 130 when compared to a single actuator. The sensing elements (converting motion to an electrical signal) discussed above relative to FIGS. 5 and 6 can detect motion of different regions of the compliant membrane 130.

Figure 7:
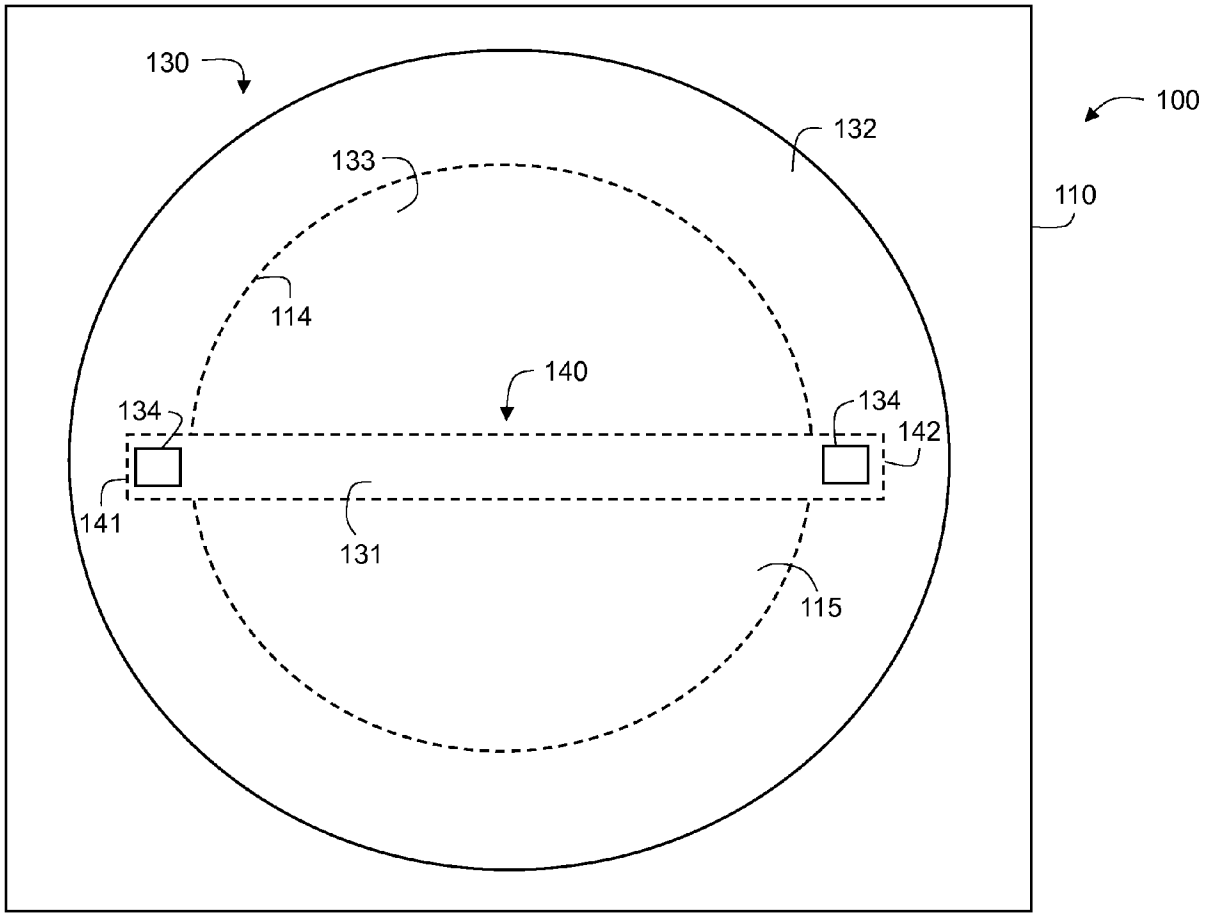
FIG. 7 is a top view of an embodiment where the MEMS composite transducer includes a doubly anchored beam and a compliant membrane.

FIG. 7 shows an embodiment of a MEMS composite transducer in a top view similar to FIG. 1A, but where the MEMS transducing member is a doubly anchored beam 140 extending across cavity 115 and having a first end 141 and a second end 142 that are each anchored to substrate 110. As in the embodiment of FIGS. 1A and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In the example of FIG. 7, a portion 134 of compliant membrane 130 is removed over both first end 141 and second end 142 in order to make electrical contact in order to pass a current from the first end 141 to the second end 142.

Figure 8A:
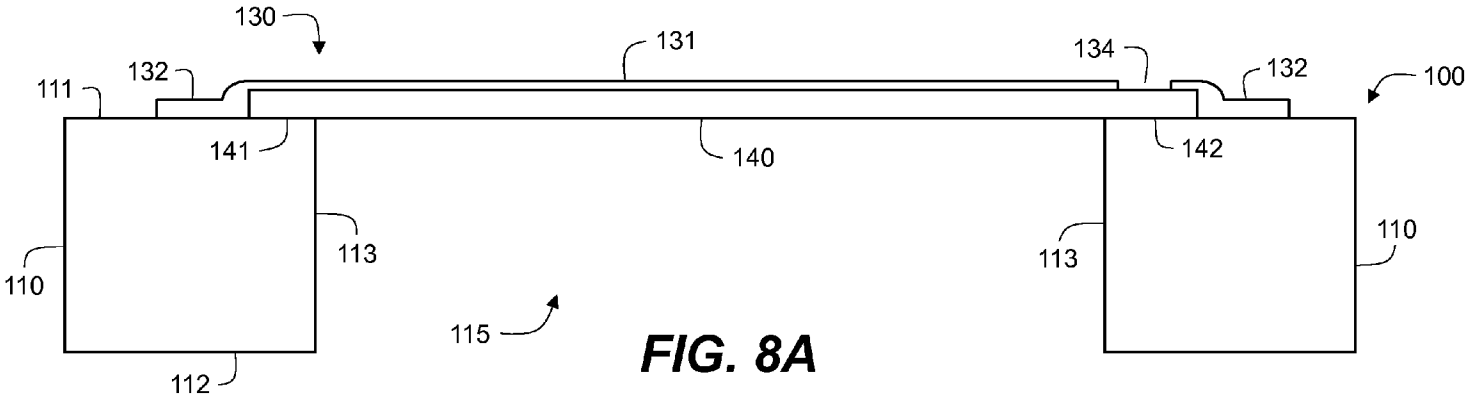
FIG. 8A is a cross-sectional view of the MEMS composite transducer of FIG. 7 in its undeflected state.

FIG. 8A shows a cross-sectional view of a doubly anchored beam 140 MEMS composite transducer in its undeflected state, similar to the cross-sectional view of the cantilevered beam 120 shown in FIG. 1B. In this example, a portion 134 of compliant membrane 130 is removed only at anchored second end 142 in order to make electrical contact on a top side of the MEMS transducing member to apply (or sense) a voltage across the MEMS transducing member as is discussed in further detail below. Similar to FIGS. 1A and 1B, the cavity 115 is substantially cylindrical and extends from a first surface 111 of substrate 110 to a second surface 112 that is opposite first surface 111.

Figure 8B:
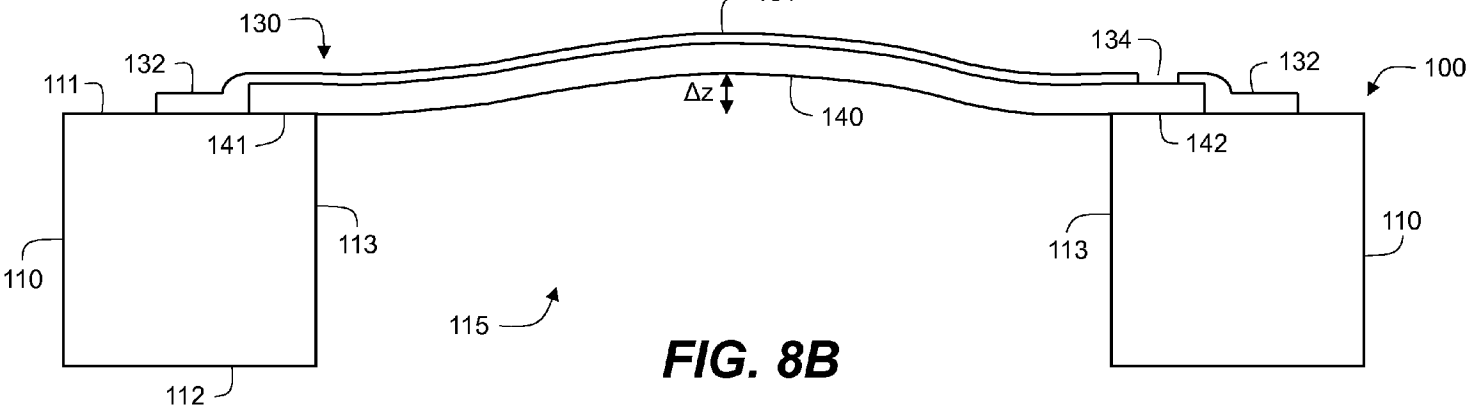
FIG. 8B is a cross-sectional view of the MEMS composite transducer of FIG. 7 in its deflected state.

FIG. 8B shows a cross-sectional view of the doubly anchored beam 140 in its deflected state, similar to the cross-sectional view of the cantilevered beam 120 shown in FIG. 2. The portion of doubly anchored beam 140 extending across cavity 115 is deflected up and away from the undeflected position of FIG. 8A, so that it raises up the portion 131 of compliant membrane 130. The maximum deflection at or near the middle of doubly anchored beam 140 is shown as $\delta=\Delta z$.

Figure 9:
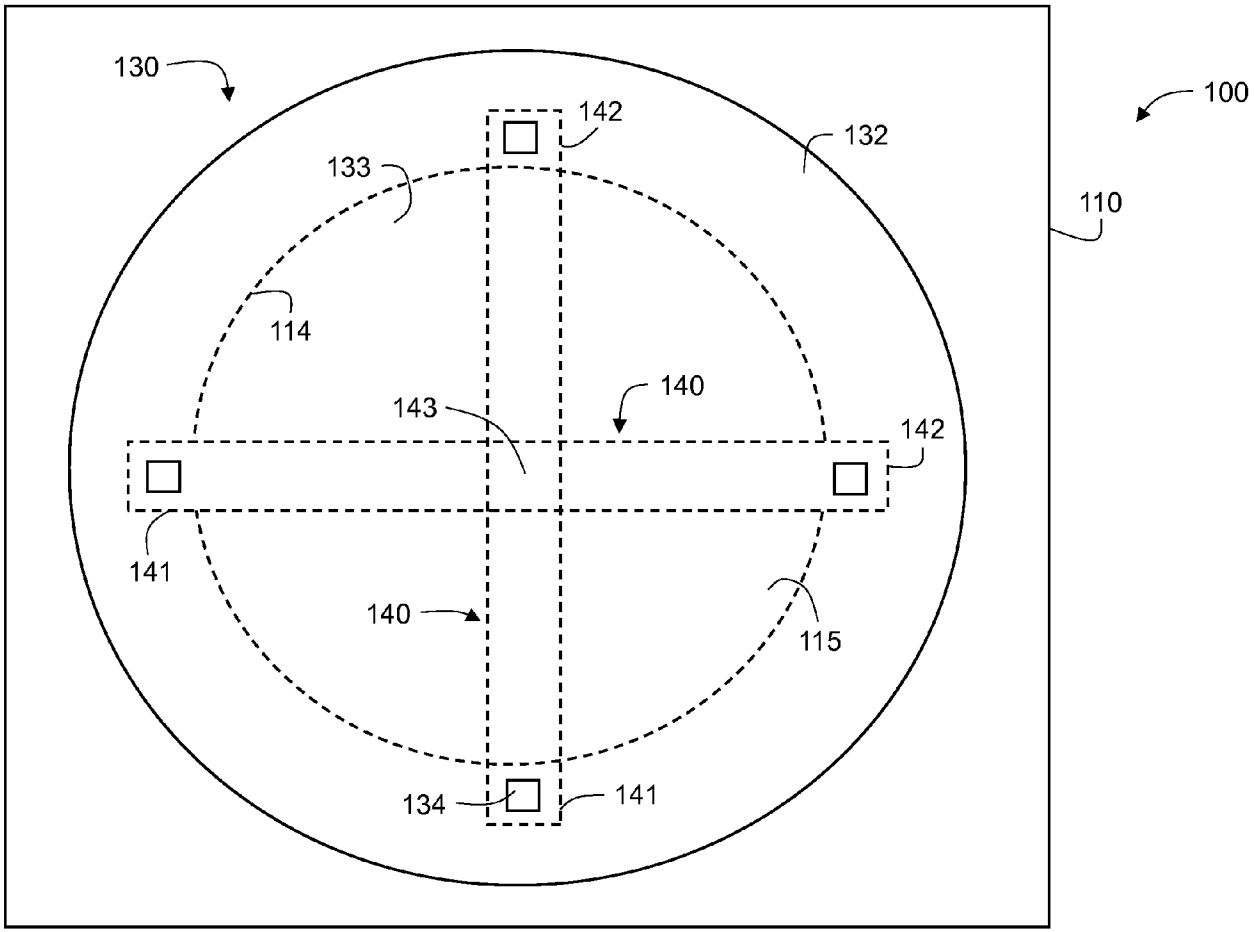
FIG. 9 is a top view of an embodiment where the MEMS composite transducer includes two intersecting doubly anchored beams and a compliant membrane.

FIG. 9 shows a top view of an embodiment similar to that of FIG. 7, but with a plurality (for example, two) of doubly anchored beams 140 anchored to the substrate 110 at their first end 141 and second end 142. In this embodiment both doubly anchored beams 140 are disposed substantially radially across circular cavity 115, and therefore the two doubly anchored beams 140 intersect each other over the cavity at an intersection region 143. Other embodiments are contemplated in which a plurality of doubly anchored beams do not intersect each other or the cavity is not circular. For example, two doubly anchored beams can be parallel to each other and extend across a rectangular cavity.

Figure 10:
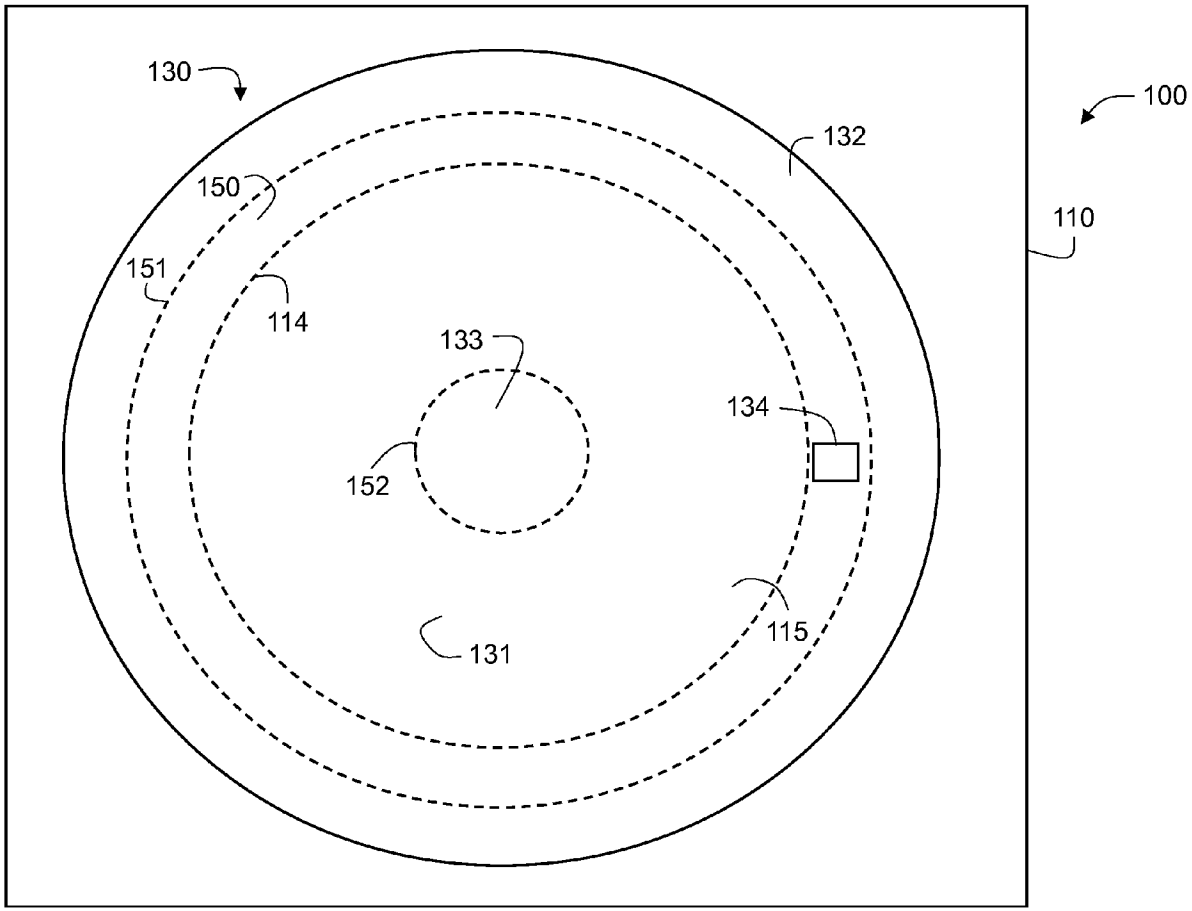
FIG. 10 is a top view of an embodiment where the MEMS composite transducer includes a clamped sheet and a compliant membrane.

FIG. 10 shows an embodiment of a MEMS composite transducer in a top view similar to FIG. 1A, but where the MEMS transducing member is a clamped sheet 150 extending across a portion of cavity 115 and anchored to the substrate 110 around the outer boundary 114 of cavity 115. Clamped sheet 150 has a circular outer boundary 151 and a circular inner boundary 152, so that it has an annular shape. As in the embodiment of FIGS. 1 and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member, so that electrical contact can be made as is discussed in further detail below.

Figure 11A:
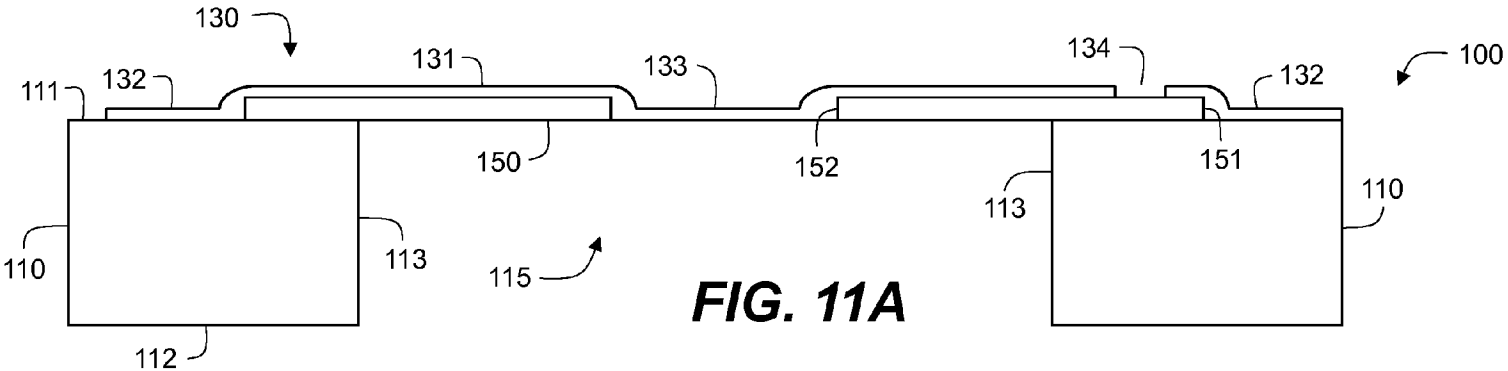
FIG. 11A is a cross-sectional view of the MEMS composite transducer of FIG. 10 in its undeflected state.

FIG. 11A shows a cross-sectional view of a clamped sheet 150 MEMS composite transducer in its undeflected state, similar to the cross-sectional view of the cantilevered beam 120 shown in FIG. 1B. Similar to FIGS. 1A and 1 B, the cavity 115 is substantially cylindrical and extends from a first surface 111 of substrate 110 to a second surface 112 that is opposite first surface 111.

Figure 11B:
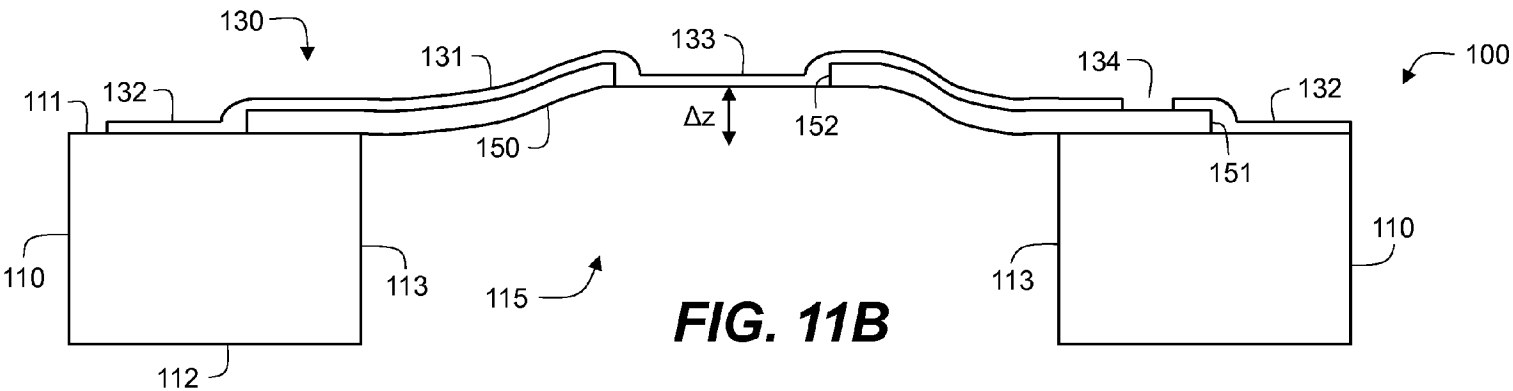
FIG. 11B is a cross-sectional view of the MEMS composite transducer of FIG. 10 in its deflected state.

FIG. 11B shows a cross-sectional view of the clamped sheet 150 in its deflected state, similar to the cross-sectional view of the cantilevered beam 120 shown in FIG. 2. The portion of clamped sheet 150 extending across cavity 115 is deflected up and away from the undeflected position of FIG. 11A, so that it raises up the portion 131 of compliant membrane 130, as well as the portion 133 that is inside inner boundary 152. The maximum deflection at or near the inner boundary 152 is shown as $\delta=\Delta z$.

Figure 12A:
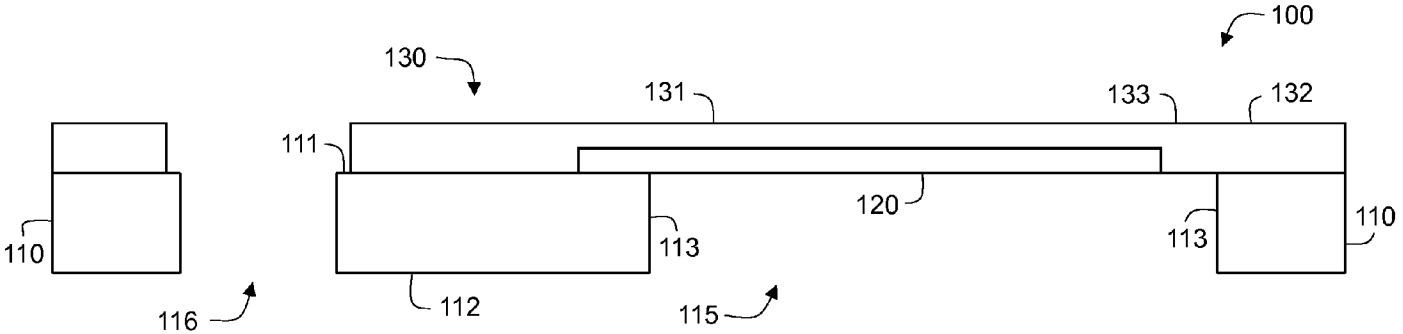
FIG. 12A is a cross-sectional view of an embodiment similar to that of FIG. 1A, but also including an additional through hole in the substrate.

FIG. 12A shows a cross sectional view of an embodiment of a composite MEMS transducer having a cantilevered beam 120 extending across a portion of cavity 115, where the cavity is a through hole from second surface 112 to first surface 111 of substrate 110. As in the embodiment of FIGS. 1 and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. Additionally in the embodiment of FIG. 12A, the substrate further includes a second through hole 116 from second surface 112 to first surface 111 of substrate 110, where the second through hole 116 is located near cavity 115. In the example shown in FIG. 12A, no MEMS transducing member extends over the second through hole 116. In other embodiments where there is an array of composite MEMS transducers formed on substrate 110, the second through hole 116 can be the cavity of an adjacent MEMS composite transducer.

Figure 12B:
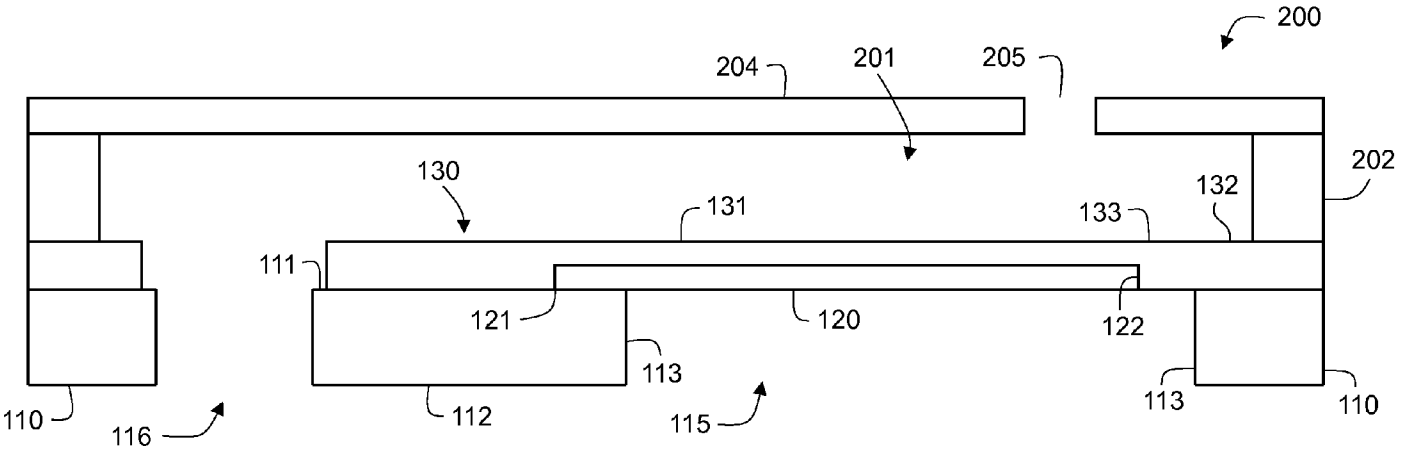
FIG. 12B is a cross-sectional view of a fluid ejector that incorporates the structure shown in FIG. 12A.

The configuration shown in FIG. 12A can be used in a fluid ejector 200 as shown in FIG. 12B. In FIG. 12B, partitioning walls 202 are formed over the anchored portion 132 of compliant membrane 130. In other embodiments (not shown), partitioning walls 202 are formed on first surface 111 of substrate 110 in a region where compliant membrane 130 has been removed. Partitioning walls 202 define a chamber 201. A nozzle plate 204 is formed over the partitioning walls and includes a nozzle 205 disposed near second end 122 of the cantilevered beam 120. Through hole 116 is a fluid feed that is fluidically connected to chamber 201, but not fluidically connected to cavity 115. Fluid is provided to cavity 201 through the fluid feed (through hole 116). When an electrical signal is provided to the MEMS transducing member (cantilevered beam 120) at an electrical connection region (not shown), second end 122 of cantilevered beam 120 and a portion of compliant membrane 130 are deflected upward and away from cavity 115 (as shown in FIG. 2), so that a drop of fluid is ejected through nozzle 205.

Figure 13:
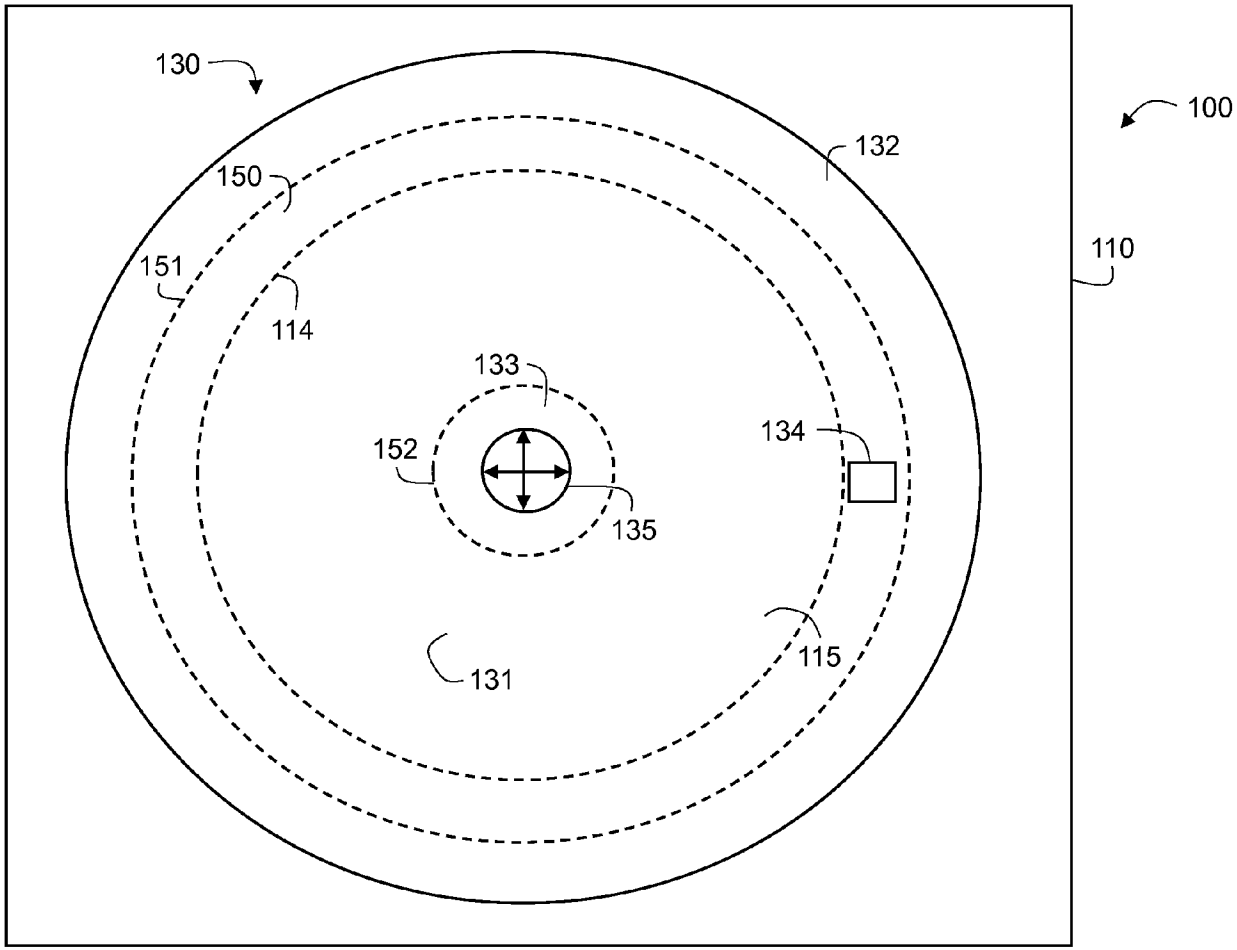
FIG. 13 is a top view of an embodiment similar to that of FIG. 10, but where the compliant membrane also includes a hole.
Figure 14:
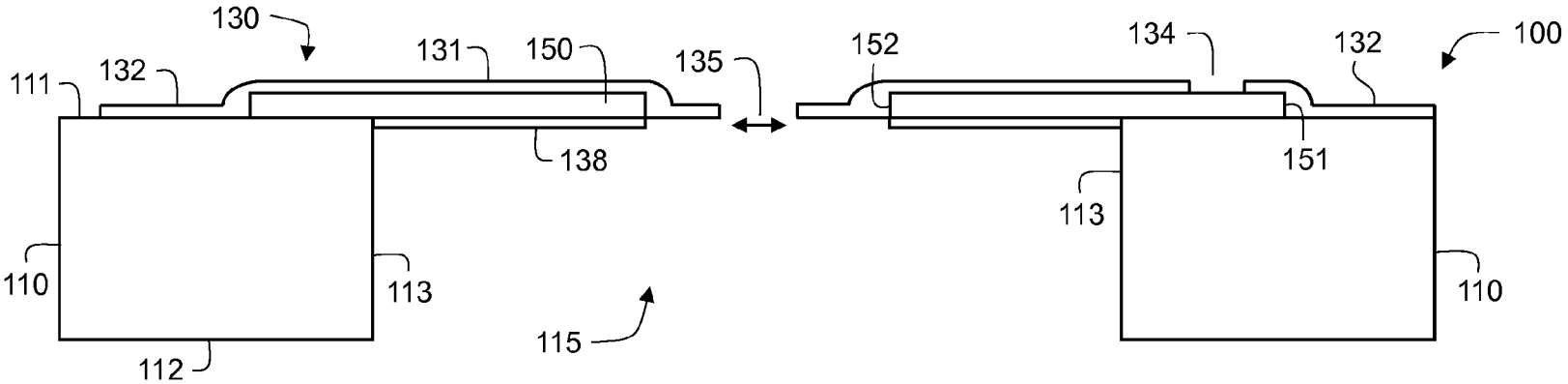
FIG. 14 is a cross-sectional view of the embodiment shown in FIG. 13.

The embodiment shown in FIG. 13 is similar to the embodiment of FIG. 10, where the MEMS transducing member is a clamped sheet 150, but in addition, compliant membrane 130 includes a hole 135 at or near the center of cavity 115. As also illustrated in FIG. 14, the MEMS composite transducer is disposed along a plane, and at least a portion of the MEMS composite transducer is movable within the plane. In particular, the clamped sheet 150 in FIGS. 13 and 14 is configured to expand and contract radially, causing the hole 135 to expand and contract, as indicated by the double-headed arrows. Such an embodiment can be used in a drop generator for a continuous fluid jetting device, where a pressurized fluid source is provided to cavity 115, and the hole 135 is a nozzle. The expansion and contraction of hole 135 stimulates the controllable break-off of the stream of fluid into droplets. Optionally, a compliant passivation material 138 can be formed on the side of the MEMS transducing material that is opposite the side that the portion 131 of compliant membrane 130 is formed on. Compliant passivation material 138 together with portion 131 of compliant membrane 130 provide a degree of isolation of the MEMS transducing member (clamped sheet 150) from the fluid being directed through cavity 115.

Figure 15:
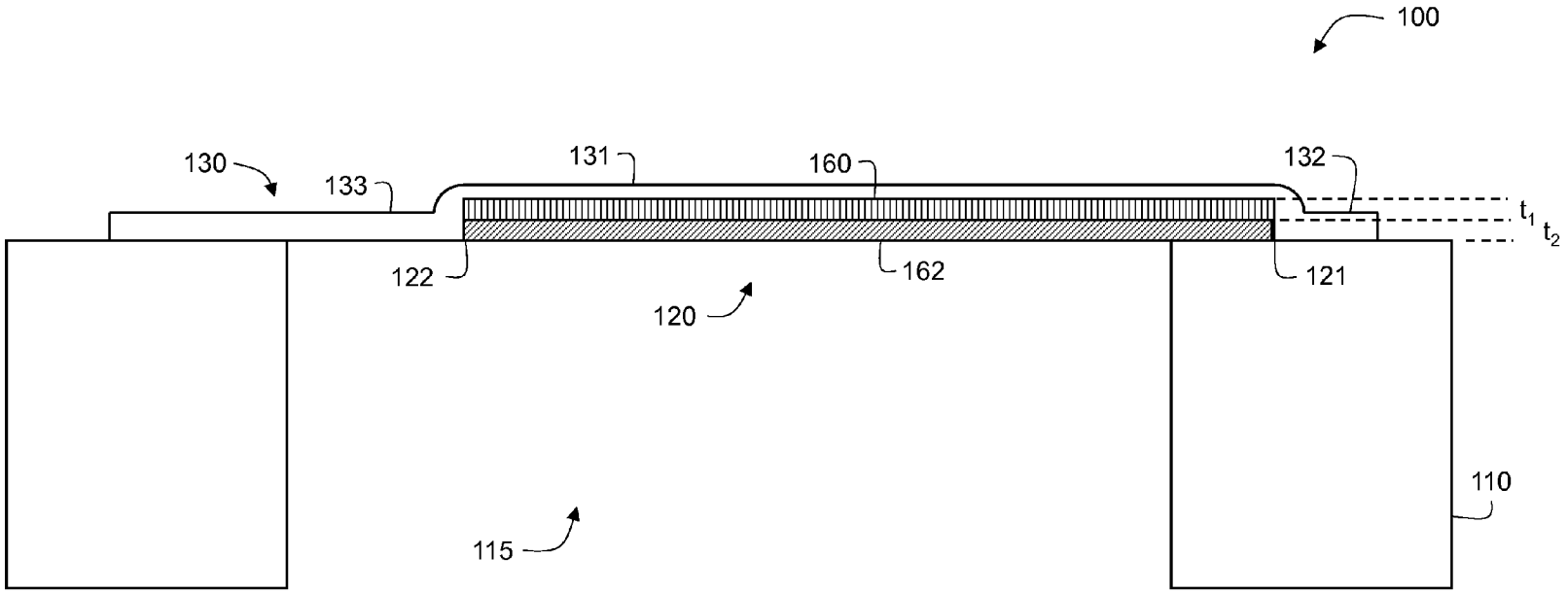
FIG. 15 is a cross-sectional view showing additional structural detail of an embodiment of a MEMS composite transducer including a cantilevered beam.

A variety of transducing mechanisms and materials can be used in the MEMS composite transducer of the present invention. Some of the MEMS transducing mechanisms include a deflection out of the plane of the undeflected MEMS composite transducer that includes a bending motion as shown in FIGS. 2, 8B and 11B. A transducing mechanism including bending is typically provided by a MEMS transducing material 160 in contact with a reference material 162, as shown for the cantilevered beam 120 in FIG. 15. In the example of FIG. 15, the MEMS transducing material 160 is shown on top of reference material 162, but alternatively the reference material 162 can be on top of the MEMS transducing material 160, depending upon whether it is desired to cause bending of the MEMS transducing member (for example, cantilevered beam 120) into the cavity 115 or away from the cavity 115, and whether the MEMS transducing material 160 is caused to expand more than or less than an expansion of the reference material 162.

One example of a MEMS transducing material 160 is the high thermal expansion member of a thermally bending bimorph. Titanium aluminide can be the high thermal expansion member, for example, as disclosed in commonly assigned U.S. Pat. No. 6,561,627. The reference material 162 can include an insulator such as silicon oxide, or silicon oxide plus silicon nitride. When a current pulse is passed through the titanium aluminide MEMS transducing material 160, it causes the titanium aluminide to heat up and expand. The reference material 160 is not self-heating and its thermal expansion coefficient is less than that of titanium aluminide, so that the titanium aluminide MEMS transducing material 160 expands at a faster rate than the reference material 162. As a result, a cantilever beam 120 configured as in FIG. 15 would tend to bend downward into cavity 115 as the MEMS transducing material 160 is heated. Dual-action thermally bending actuators can include two MEMS transducing layers (deflector layers) of titanium aluminide and a reference material layer sandwiched between, as described in commonly assigned U.S. Pat. No. 6,464,347. Deflections into the cavity 115 or out of the cavity can be selectively actuated by passing a current pulse through either the upper deflector layer or the lower deflector layer respectively.

A second example of a MEMS transducing material 160 is a shape memory alloy such as a nickel titanium alloy. Similar to the example of the thermally bending bimorph, the reference material 162 can be an insulator such as silicon oxide, or silicon oxide plus silicon nitride. When a current pulse is passed through the nickel titanium MEMS transducing material 160, it causes the nickel titanium to heat up. A property of a shape memory alloy is that a large deformation occurs when the shape memory alloy passes through a phase transition. If the deformation is an expansion, such a deformation would cause a large and abrupt expansion while the reference material 162 does not expand appreciably. As a result, a cantilever beam 120 configured as in FIG. 15 would tend to bend downward into cavity 115 as the shape memory alloy MEMS transducing material 160 passes through its phase transition. The deflection would be more abrupt than for the thermally bending bimorph described above.

A third example of a MEMS transducing material 160 is a piezoelectric material. Piezoelectric materials are particularly advantageous, as they can be used as either actuators or sensors. In other words, a voltage applied across the piezoelectric MEMS transducing material 160, typically applied to conductive electrodes (not shown) on the two sides of the piezoelectric MEMS transducing material, can cause an expansion or a contraction (depending upon whether the voltage is positive or negative and whether the sign of the piezoelectric coefficient is positive or negative). While the voltage applied across the piezoelectric MEMS transducing material 160 causes an expansion or contraction, the reference material 162 does not expand or contract, thereby causing a deflection into the cavity 115 or away from the cavity 115 respectively. Typically in a piezoelectric composite MEMS transducer, a single polarity of electrical signal would be applied however, so that the piezoelectric material does not tend to become depoled. It is possible to sandwich a reference material 162 between two piezoelectric material layers, thereby enabling separate control of deflection into cavity 115 or away from cavity 115 without depoling the piezoelectric material. Furthermore, an expansion or contraction imparted to the MEMS transducing material 160 produces an electrical signal which can be used to sense motion. There are a variety of types of piezoelectric materials. One family of interest includes piezoelectric ceramics, such as lead zirconate titanate or PZT.

As the MEMS transducing material 160 expands or contracts, there is a component of motion within the plane of the MEMS composite transducer, and there is a component of motion out of the plane (such as bending). Bending motion (as in FIGS. 2, 8B and 11B) will be dominant if the Young's modulus and thickness of the MEMS transducing material 160 and the reference material 162 are comparable. In other words, if the MEMS transducing material 160 has a thickness $t_1$ and if the reference material has a thickness $t_2$, then bending motion will tend to dominate if $t_2>0.5t_1$ and $t_2<2t_1$, assuming comparable Young's moduli. By contrast, if $t_2<0.2t_1$, motion within the plane of the MEMS composite transducer (as in FIGS. 13 and 14) will tend to dominate.

Figure 16A:
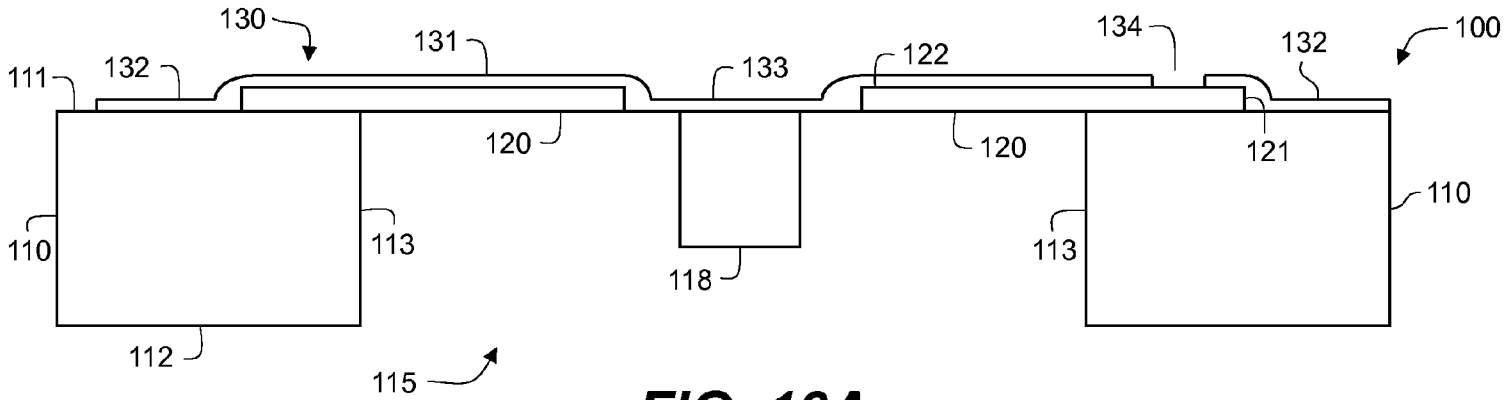
FIG. 16A is a cross-sectional view of an embodiment similar to that of FIG. 6, but also including an attached mass that extends into the cavity.
Figure 16B:
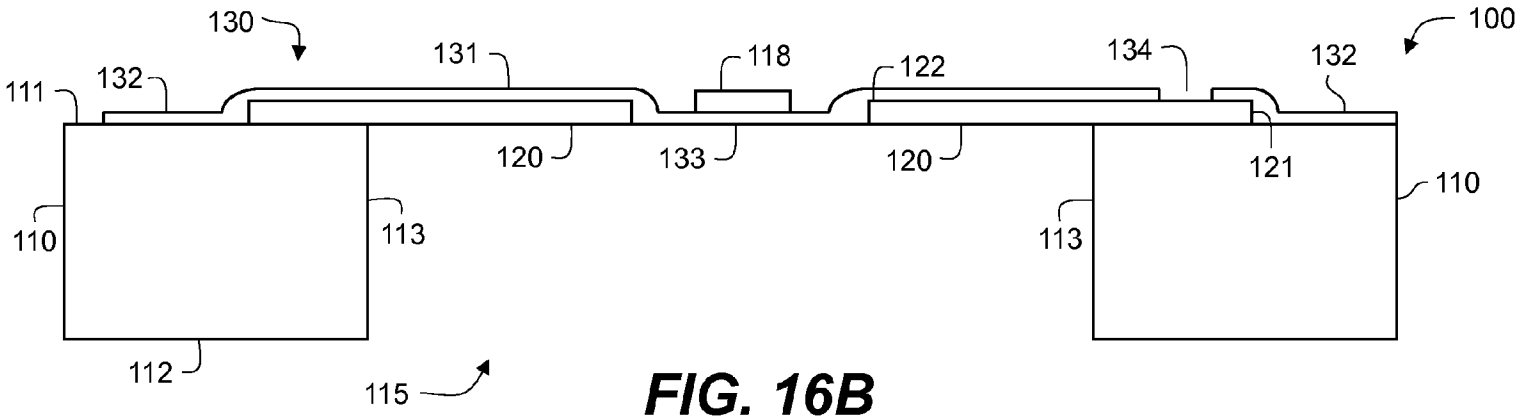
FIG. 16B is a cross-sectional view of an embodiment similar to that of FIG. 16A, but where the attached mass is on the opposite side of the compliant membrane.

Some embodiments of MEMS composite transducer 100 include an attached mass, in order to adjust the resonant frequency for example (see equation 2 in the background). The mass 118 can be attached to the portion 133 of the compliant membrane 130 that overhangs cavity 115 but does not contact the MEMS transducing member, for example. In the embodiment shown in the cross-sectional view of FIG. 16A including a plurality of cantilevered beams 120 (such as the configuration shown in FIG. 6), mass 118 extends below portion 133 of compliant membrane 130, so that it is located within the cavity 115. Alternatively, mass 118 can be affixed to the opposite side of the compliant membrane 130, as shown in FIG. 16B. The configuration of FIG. 16A can be particularly advantageous if a large mass is needed. For example, a portion of silicon substrate 110 can be left in place when cavity 115 is etched as described below. In such a configuration, mass 118 would typically extend the full depth of the cavity. In order for the MEMS composite transducer to vibrate without crashing of mass 118, substrate 110 would typically be mounted on a mounting member (not shown) including a recess below cavity 115. For the configuration shown in FIG. 16B, the attached mass 118 can be formed by patterning an additional layer over the compliant membrane 130.

Figure 17A:
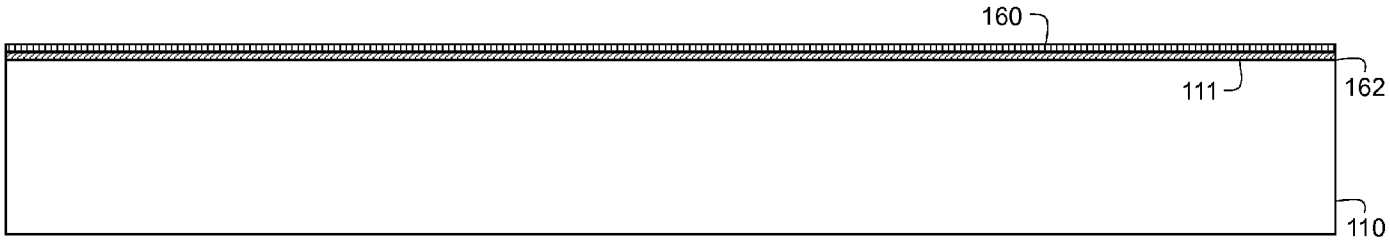
FIGS. 17A to 17E illustrate an overview of a method of fabrication.
Figure 17B:
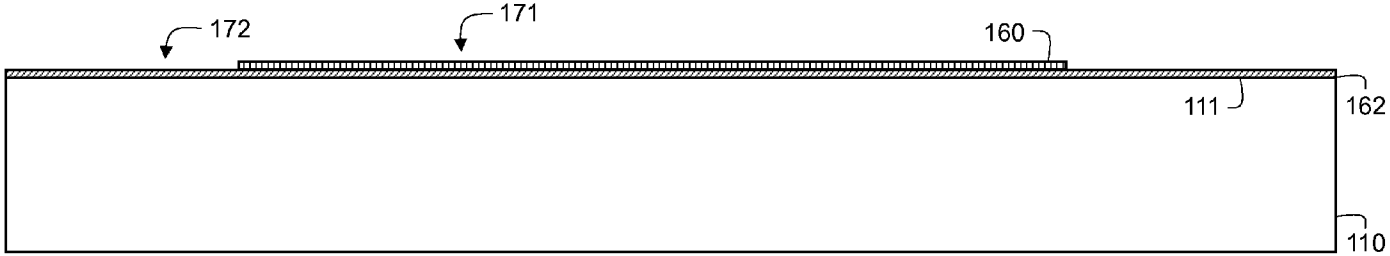
Figure 17C:
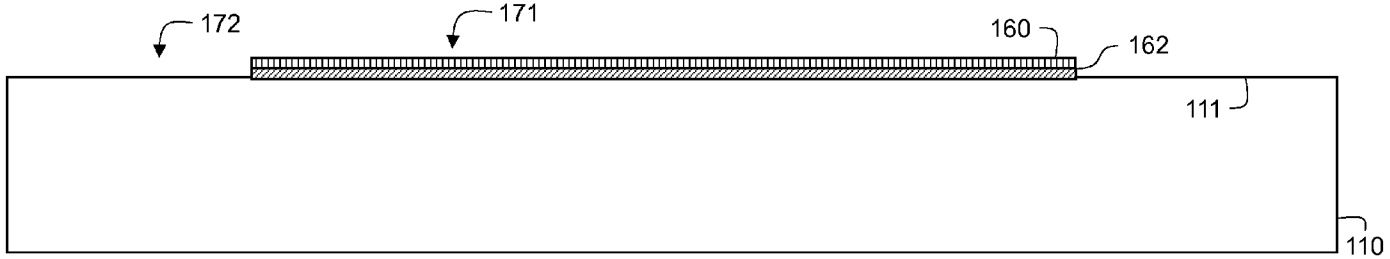

Having described a variety of exemplary structural embodiments of MEMS composite transducers, a context has been provided for describing methods of fabrication. FIGS. 17A to 17E provide an overview of a method of fabrication. As shown in FIG. 17A, a reference material 162 and a transducing material 160 are deposited over a first surface 111 of a substrate 110, which is typically a silicon wafer. Further details regarding materials and deposition methods are provided below. The reference material 162 can be deposited first (as in FIG. 17A) followed by deposition of the transducing material 160, or the order can be reversed. In some instances, a reference material might not be required. In any case, it can be said that the transducing material 160 is deposited over the first surface 111 of substrate 110. The transducing material 160 is then patterned and etched, so that transducing material 160 is retained in a first region 171 and removed in a second region 172 as shown in FIG. 17B. The reference material 162 is also patterned and etched, so that it is retained in first region 171 and removed in second region 172 as shown in FIG. 17C.

Figure 17D:
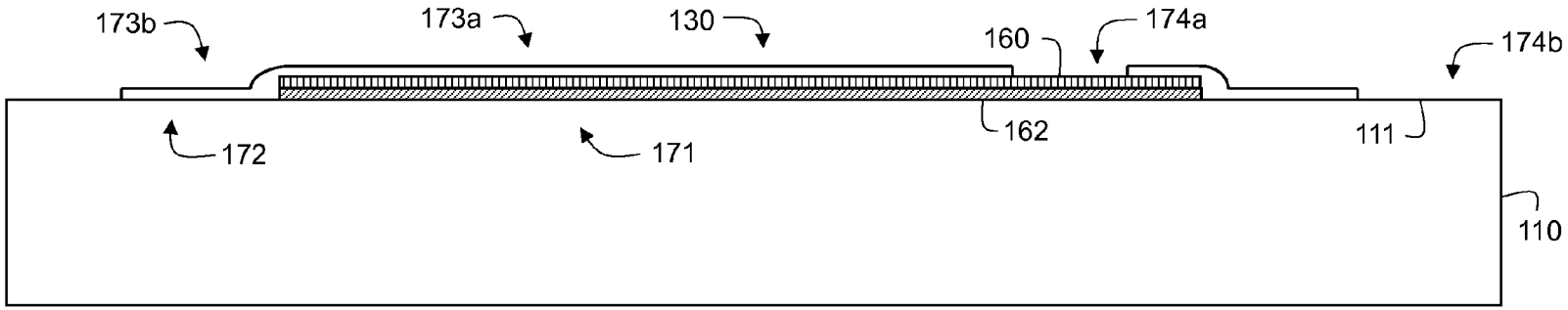
Figure 17E:
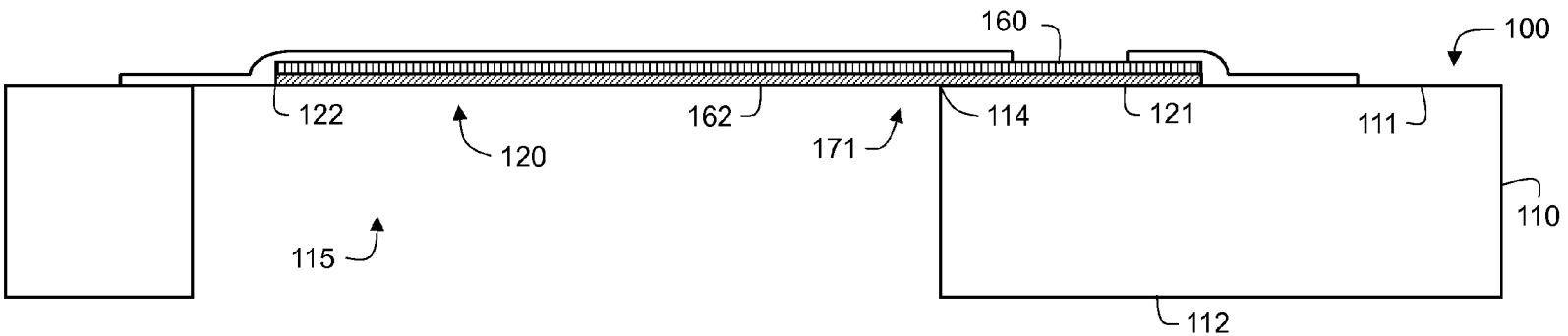

As shown in FIG. 17D, a polymer layer (for compliant membrane 130) is then deposited over the first and second regions 171 and 172, and patterned such that polymer is retained in a third region 173 and removed in a fourth region 174. A first portion 173*a* where polymer is retained is coincident with a portion of first region 171 where transducing material 160 is retained. A second portion 173*b* where polymer is retained is coincident with a portion of second region 172 where transducing material 160 is removed. In addition, a first portion 174*a* where polymer is removed is coincident with a portion of first region 171 where transducing material 160 is retained. A second portion 174*b* where polymer is removed is coincident with a portion of second region 172 where transducing material 160 is removed. A cavity 115 is then etched from a second surface 112 (opposite first surface 111) to first surface 111 of substrate 110, such that an outer boundary 114 of cavity 115 at the first surface 111 of substrate 110 intersects the first region 171 where transducing material 160 is retained, so that a first portion of transducing material 160 (including first end 121 of cantilevered beam 120 in this example) is anchored to first surface 111 of substrate 110, and a second portion of transducing material 160 (including second end 122 of cantilevered beam 120) extends over at least a portion of cavity 115. When it is said that a first portion of transducing material 160 is anchored to first surface 111 of substrate 110, it is understood that transducing material 160 can be in direct contact (not shown) with first surface 111, or transducing material 160 can be indirectly anchored to first surface 111 through reference material 162 as shown in FIG. 17E. A MEMS composite transducer 100 is thereby fabricated.

Figure 18A:
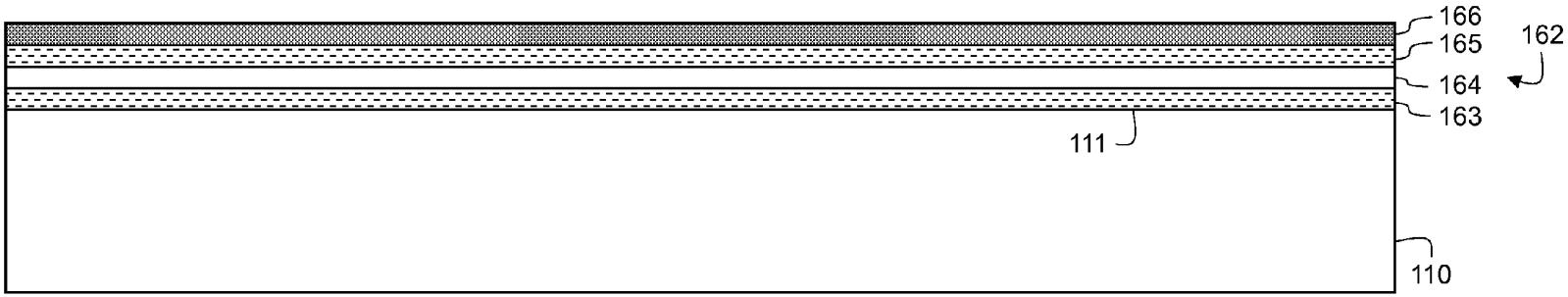
FIGS. 18A and 18B provide addition details of layers that can be part of the MEMS composite transducer.

Reference material 162 can include several layers as illustrated in FIG. 18A. A first layer 163 of silicon oxide can be deposited on first surface 111 of substrate 110. Deposition of silicon oxide can be a thermal process or it can be chemical vapor deposition (including low pressure or plasma enhanced CVD) for example. Silicon oxide is an insulating layer and also facilitates adhesion of the second layer 164 of silicon nitride. Silicon nitride can be deposited by LPCVD and provides a tensile stress component that will help the transducing material 160 to retain a substantially flat shape when the cavity is subsequently etched away. A third layer 165 of silicon oxide helps to balance the stress and facilitates adhesion of an optional bottom electrode layer 166, which is typically a platinum (or titanium/platinum) electrode for the case of a piezoelectric transducing material 160. The platinum electrode layer is typically deposited by sputtering.

Figure 18B:
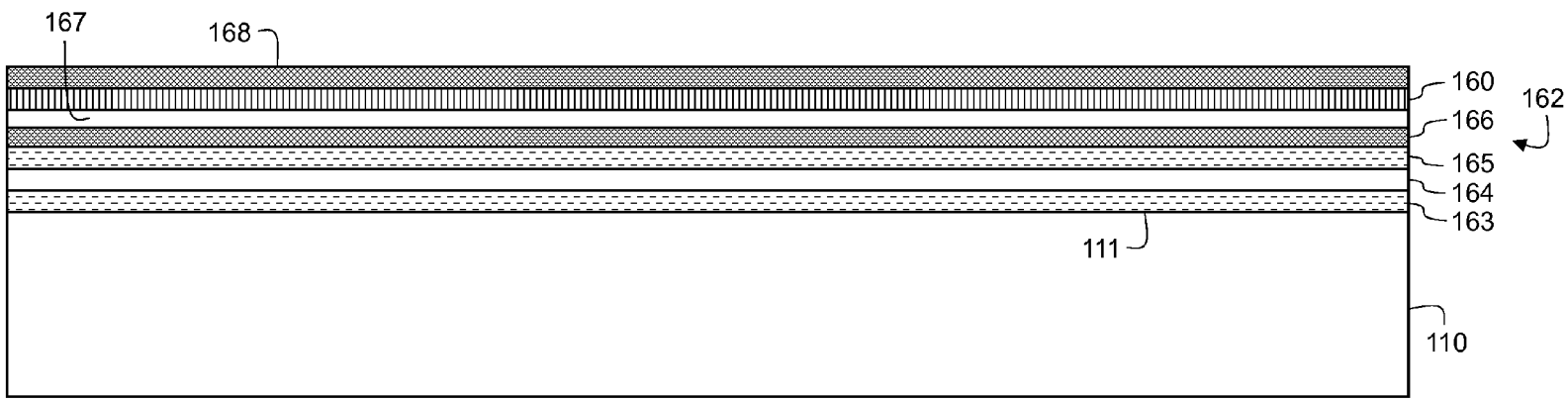

Deposition of the transducing material 160 will next be described for the case of a piezoelectric ceramic transducing material, such as PZT. An advantageous configuration is the one shown in FIG. 18B in which a voltage is applied across PZT transducing material 160 from a top electrode 168 to a bottom electrode 166. The desired effect on PZT transducing material 160 is an expansion or contraction along the x-y plane parallel to surface 111 of substrate 110. As described above, such an expansion or contraction can cause a deflection into the cavity 115 or out of the cavity 115 respectively, or a substantially in-plane motion, depending on the relative thicknesses and stiffnesses of the PZT transducing material 160 and the reference material 162. Thicknesses are not to scale in FIGS. 18A and 18B. Typically for a bending application where the reference material 162 has a comparable stiffness to the MEMS transducing material 160, the reference material 162 is deposited in a thickness of about 1 micron, as is the transducing material 160, although for in-plane motion the reference material thickness is typically 20% or less of the transducing material thickness, as described above. The transverse piezoelectric coefficients $d_{31}$ and $e_{31}$ are relatively large in magnitude for PZT (and can be made to be larger and stabilized if poled in a relatively high electric field). To orient the PZT crystals such that transverse piezoelectric coefficients $d_{31}$ and $e_{31}$ are the coefficients relating voltage across the transducing layer and expansion or contraction in the x-y plane, it is desired that the (001) planes of the PZT crystals be parallel to the x-y plane (parallel to the bottom platinum electrode layer 166 as shown in FIG. 18B). However, PZT material will tend to orient with its planes parallel to the planes of the material upon which it is deposited. Because the platinum bottom electrode layer 166 typically has its (111) planes parallel to the x-y plane when deposited on silicon oxide, a seed layer 167, such as lead oxide or lead titanate can be deposited over bottom electrode layer 166 in order to provide the (001) planes on which to deposit the PZT transducing material 160. Then the upper electrode layer 168 (typically platinum) is deposited over the PZT transducing material 160, e.g. by sputtering.

Deposition of the PZT transducing material 160 can be done by sputtering. Alternatively, deposition of the PZT transducing material 160 can be done by a sal-gel process. In the sol-gel process, a precursor material including PZT particles in an organic liquid is applied over first surface 111 of substrate 110. For example, the precursor material can be applied over first surface 111 by spinning the substrate 110. The precursor material is then heat treated in a number of steps. In a first step, the precursor material is dried at a first temperature. Then the precursor material is pyrolyzed at a second temperature higher than the first temperature in order to decompose organic components. Then the PZT particles of the precursor material are crystallized at a third temperature higher than the second temperature. PZT deposited by a sol-gel process is typically done using a plurality of thin layers of precursor material in order to avoid cracking in the material of the desired final thickness.

For embodiments where the transducing material 160 is titanium aluminide for a thermally bending actuator, or a shape memory alloy such as a nickel titanium alloy, deposition can be done by sputtering. In addition, layers such as the top and bottom electrode layers 166 and 168, as well as seed layer 167 are not required.

In order to pattern the stack of materials shown in FIGS. 18A and 18B, a photoresist mask is typically deposited over the top electrode layer 168 and patterned to cover only those regions where it is desired for material to remain. Then at least some of the material layers are etched at one time. For example, plasma etching using a chlorine based process gas can be used to etch the top electrode layer 168, the PZT transducing material 160, the seed layer 167 and the bottom electrode layer 166 in a single step. Alternatively the single step can include wet etching. Depending on materials, the rest of the reference material 162 can be etched in the single step. However, in some embodiments, the silicon oxide layers 163 and 165 and the silicon nitride layer 164 can be etched in a subsequent plasma etching step using a fluorine based process gas.

Depositing the polymer layer for compliant membrane 130 can be done by laminating a film, such as TMMF, or spinning on a liquid resist material, such as TMMR, as referred to above. As the polymer layer for the compliant membrane is applied while the transducers are still supported by the substrate, pressure can be used to apply the TMMF or other laminating film to the structure without risk of breaking the transducer beams. An advantage of TMMR and TMMF is that they are photopatternable, so that application of an additional resist material is not required. An epoxy polymer further has desirable mechanical properties as mentioned above.

In order to etch cavity 115 (FIG. 17E) a masking layer is applied to second surface 112 of substrate 110. The masking layer is patterned to expose second surface 112 where it is desired to remove substrate material. The exposed portion can include not only the region of cavity 115, but also the region of through hole 116 of fluid ejector 200 (see FIGS. 12A and 12B). For the case of leaving a mass affixed to the bottom of the compliant membrane 130, as discussed above relative to FIG. 16A, the region of cavity 115 can be masked with a ring pattern to remove a ring-shaped region, while leaving a portion of substrate 110 attached to compliant membrane 130. For embodiments where substrate 110 is silicon, etching of substantially vertical walls (portions 113 of substrate 110, as shown in a number of the cross-sectional views including FIG. 1B) is readily done using a deep reactive ion etching (DRIE) process. Typically, a DRIE process for silicon uses $SF_6$ as a process gas.

As described above, one application for which MEMS composite transducer 100 is particularly well suited is as a drop generator 395 (also commonly referred to as a drop forming mechanism) in a continuous liquid ejection system 300. Example embodiments of continuous liquid ejection systems are described in more detail below with reference to FIGS. 19-31 and back to FIGS. 13 and 14. When used as the drop generator 395 (drop forming mechanism) in a continuous liquid ejection system, MEMS composite transducer 100 is included in a jetting module 305 (discussed in more detail below) of the continuous liquid ejection system 300.

Generally referring to FIGS. 19A-31 and back to FIGS. 13 and 14, jetting module 305 includes substrate 110 and an orifice plate 315. Portions of substrate 110 define a liquid chamber 310. Orifice plate 315 includes MEMS composite transducer 100 which includes a MEMS transducing member (a first MEMS transducing member in some example embodiments) and a compliant membrane 320. The orifice plate is affixed to substrate 110. Typically, compliant membrane 320 is a compliant polymeric membrane made from one of the polymers described above. However, compliant membrane 320 can be any of the compliant membranes described above depending on the specific application contemplated.

A first portion 121, 151 of the MEMS transducing member is anchored to substrate 110 and a second portion 122, 152 of the MEMS transducing member extends over at least a portion of liquid chamber 310. The second portion 122, 152 of the MEMS transducing member is free to move relative to liquid chamber 310. In FIGS. 13, 14, 19A, and 19B, the MEMS transducing member includes clamped sheet 150. In FIGS. 20-23B, the MEMS transducing member includes cantilevered beam 120.

A compliant membrane 320 is positioned in contact with the MEMS transducing member. A first portion 131 of compliant membrane 320 covers the MEMS transducing member and a second portion 132 of compliant membrane 320 is anchored to substrate 110. Compliant membrane 320 includes an orifice 135.

Figure 19A:
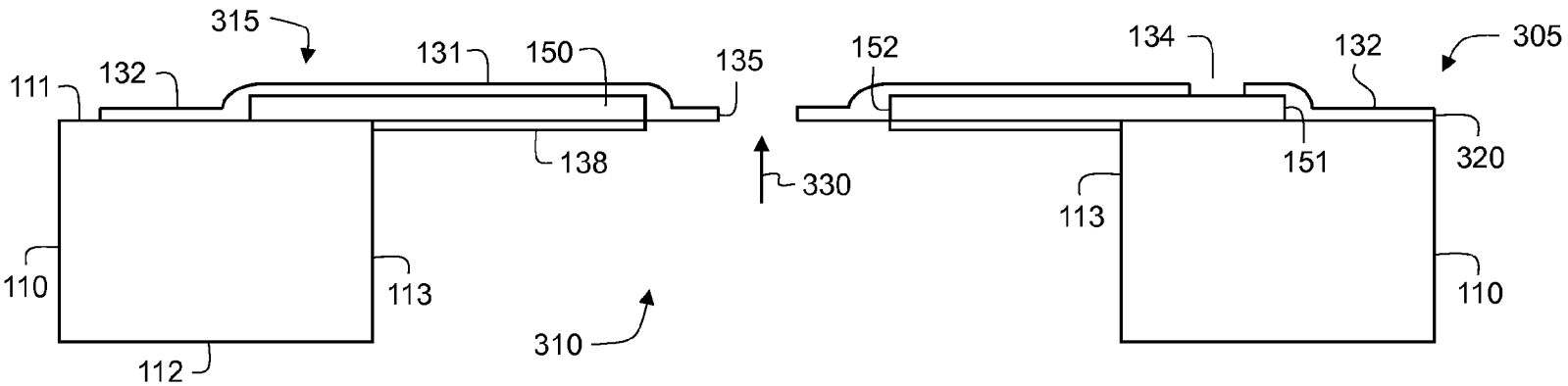
FIG. 19A is a schematic cross-sectional view of an example embodiment of a jetting module of a continuous liquid ejection system made in accordance with the present invention.
Figure 19B:
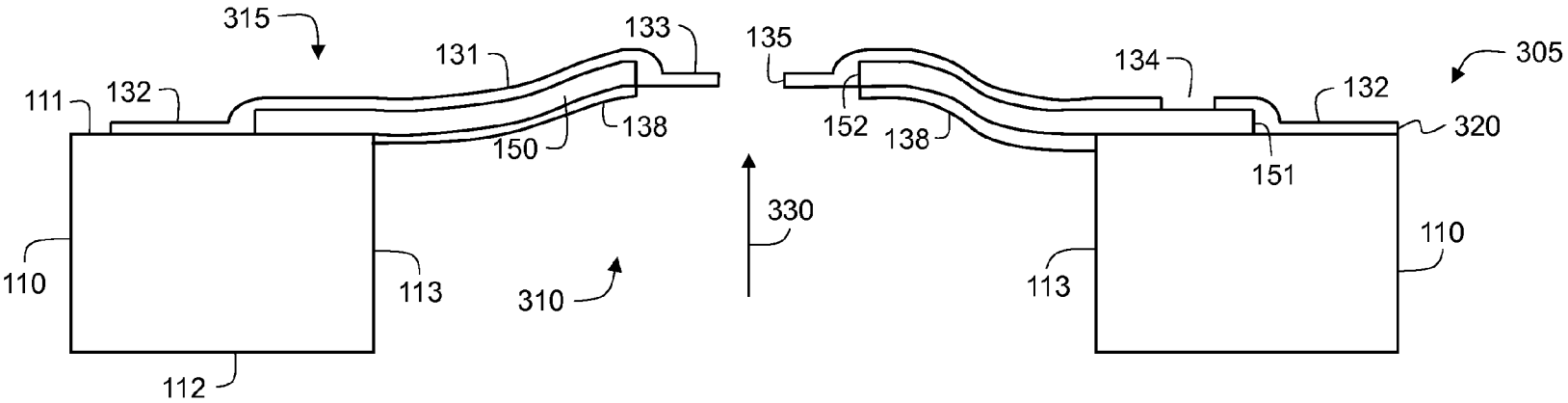
FIG. 19B is a schematic cross-sectional view of the example embodiment shown in FIG. 19A with the drop generator in an actuated position.
Figure 20:
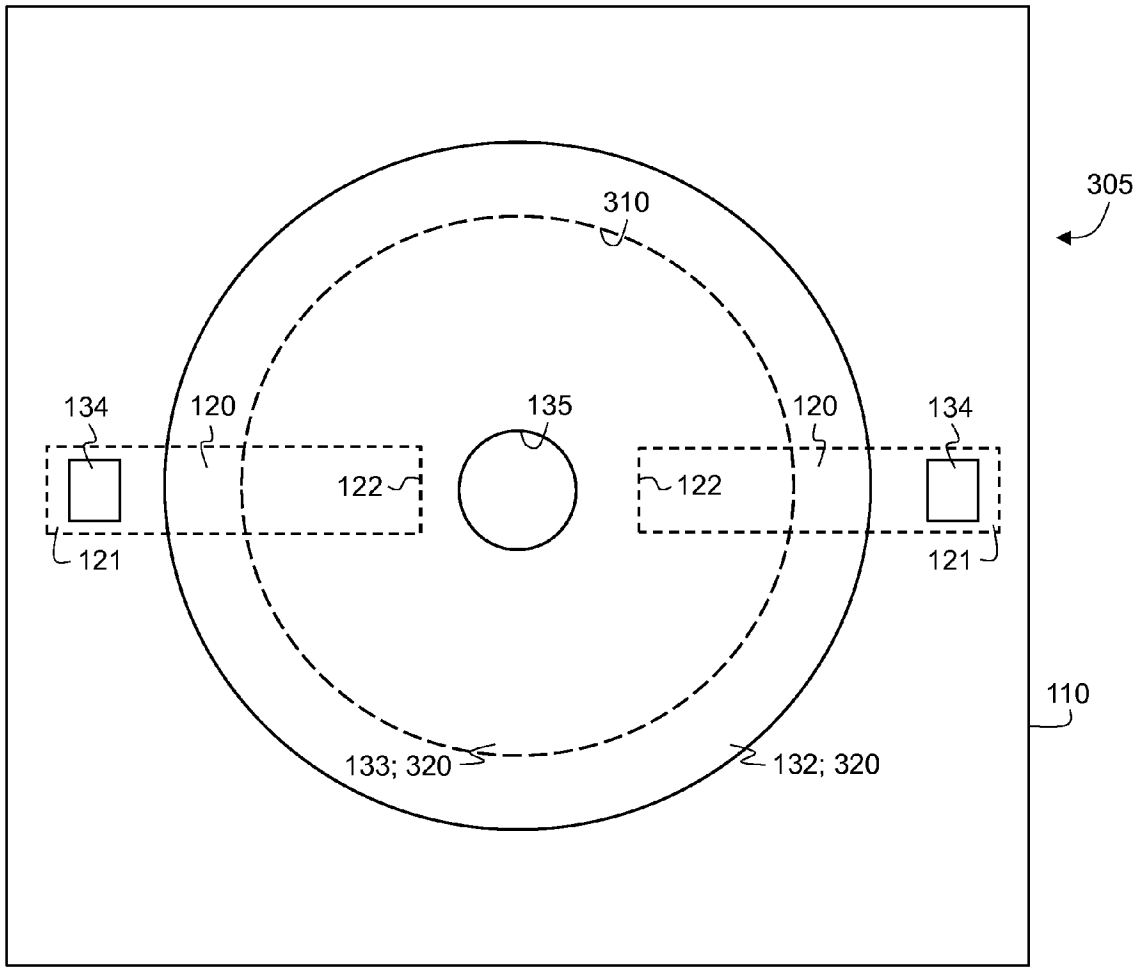
FIG. 20 is a schematic top view of another example embodiment of a jetting module of a continuous liquid ejection system made in accordance with the present invention.
Figure 25:
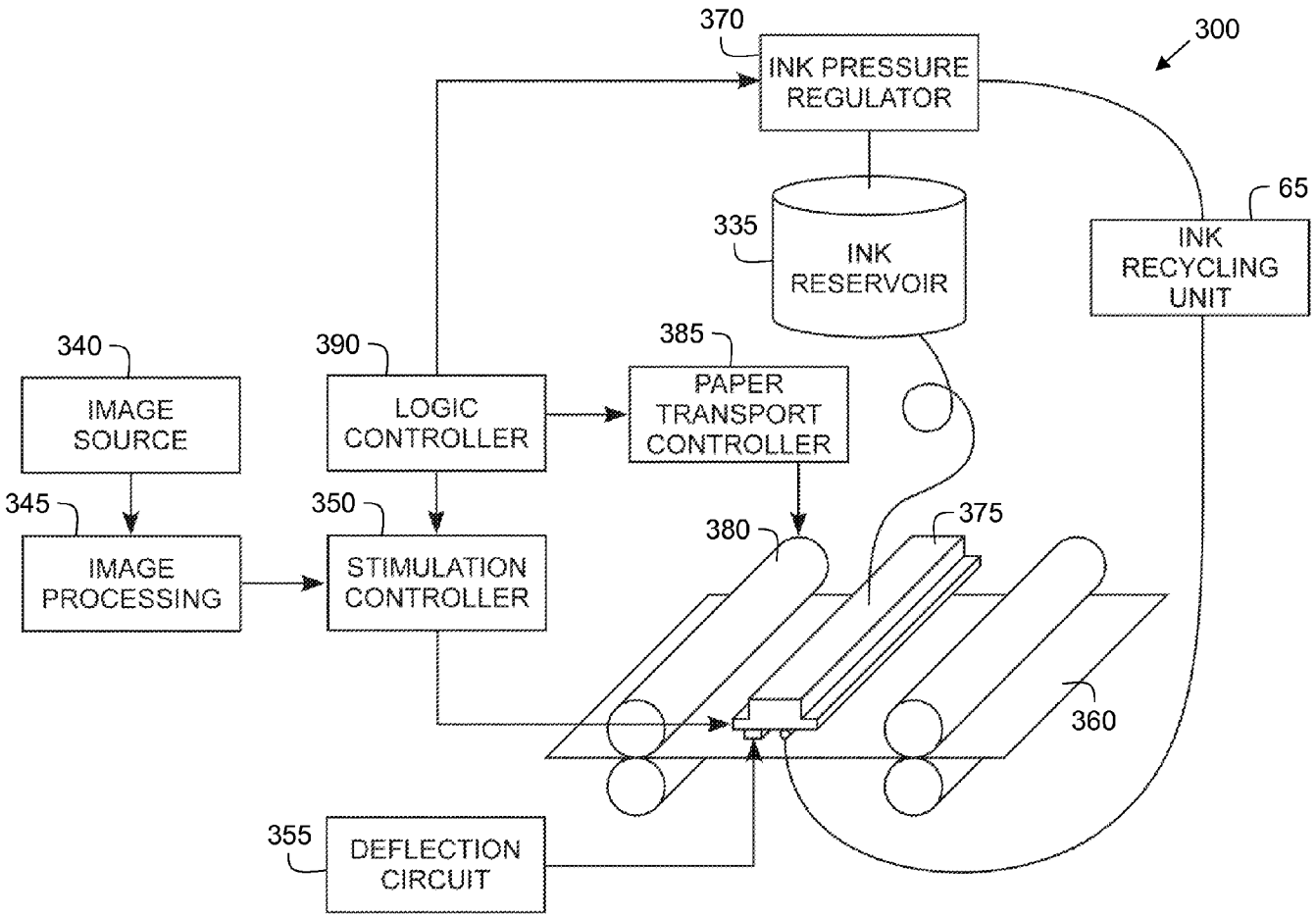
FIGS. 25-27B show an example embodiment of a continuous liquid ejection system made in accordance with the present invention.
Figure 28:
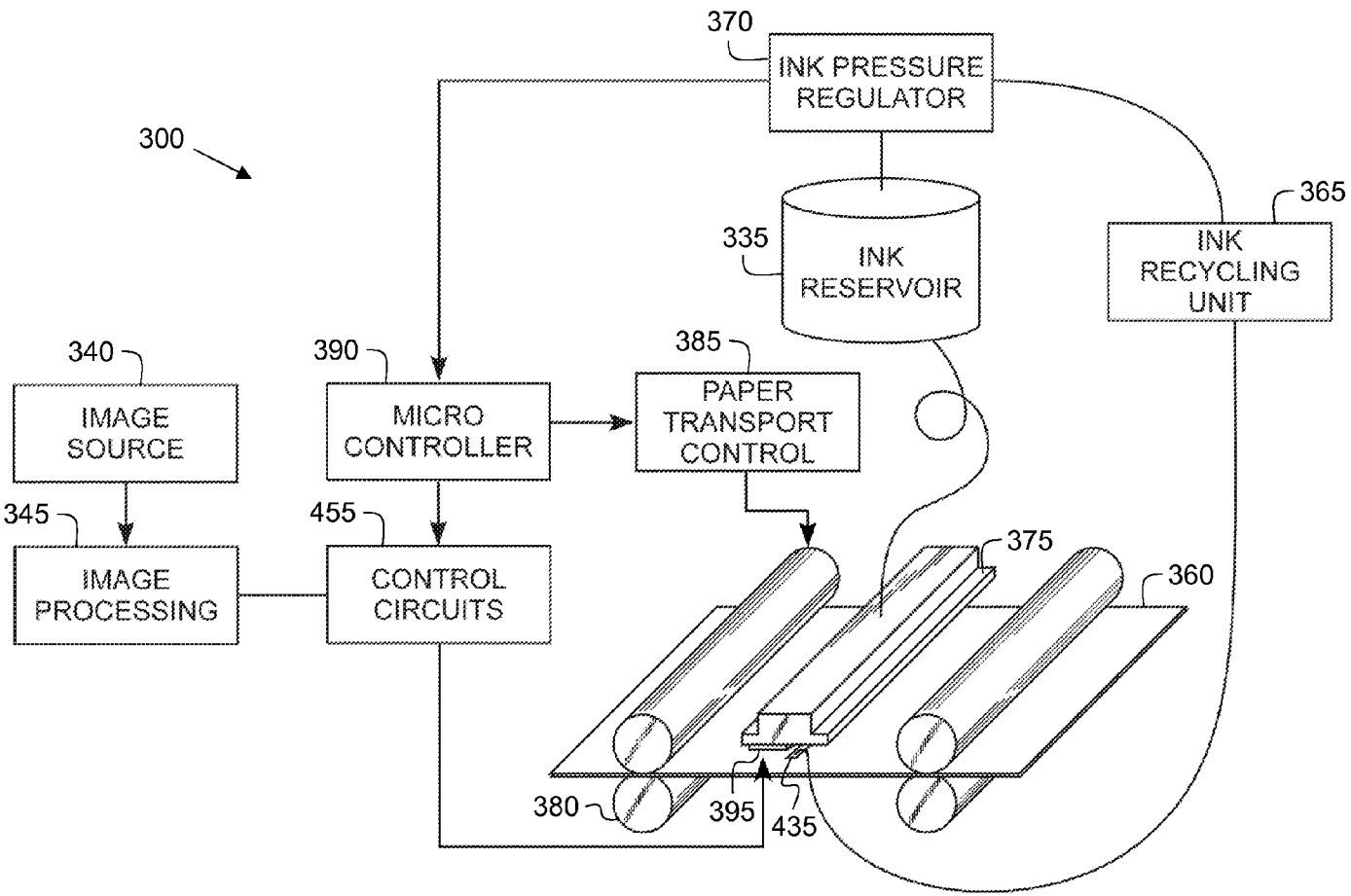
FIGS. 28-30 show another example embodiment of a continuous liquid ejection system made in accordance with the present invention.

Continuous liquid ejection system 300 includes a liquid supply 325 (for example, liquid reservoir 335 and liquid pressure regulator 370 shown in FIGS. 25 and 28) that provides a liquid to liquid chamber 310 under a pressure sufficient to eject a continuous jet 405 of the liquid (shown in FIGS. 26A and 29) through orifice 135 located in compliant membrane 320 of orifice plate 315 (shown in FIGS. 19A and 19B). The MEMS transducing member is selectively actuated to cause a portion of compliant membrane 320 to be displaced relative to liquid chamber 310 causing a drop of liquid (shown in FIGS. X and Y) to break off from the liquid jet (shown in FIGS. X and Y).

Referring to FIGS. 13, 14, 19A, and 19B, MEMS composite transducer 100 includes one MEMS transducing member in the form of a clamped sheet 150. Compliant membrane 320 of orifice plate 315 is initially positioned in a plane, for example, a plane perpendicular to a direction of liquid jet ejection (shown using arrow 330) through orifice 135. In FIG. 14, the MEMS transducing member, clamped sheet 150, is configured to actuate in the plane of compliant membrane 320. As described above, the MEMS transducing member motion will be predominantly in plane lacks a reference material, or the reference material has much less stiffness than the MEMS transducing material. As the MEMS transducing member is clamped sheet 150 that encircles orifice 135, in-plane actuation of the MEMS transducing member (shown using the arrow included in FIG. 14) modulates the geometry of orifice 135 causing a liquid drop to break off from the liquid jet. In FIGS. 19A and 19B, the MEMS transducing member, clamped sheet 150, is configured to actuate out of the plane of the compliant membrane 320, the reference material having similar stiffness to the transducing material as described above. Drop generator 395 is shown at rest in FIG. 19A.

Expansion or contraction of the MEMS transducing member causes deflection of compliant membrane 320 (and the MEMS transducing member) into liquid chamber 310 or out of liquid chamber 310 (shown in FIG. 19B) causing a liquid drop to break off from the liquid jet. The MEMS clamped sheet transducing member 150, is shown at rest in FIG. 19A and actuated in FIG. 19B with deflection of compliant membrane 320 (and the MEMS transducing member) out of liquid chamber 310.

Referring to FIGS. 20-23B, MEMS composite transducer 100 includes a plurality of MEMS transducing members, a first MEMS transducing member (described above) and a similar second MEMS transducing member. Similar to the first MEMS transducing member, a first portion 121 of the second MEMS transducing member is anchored to substrate 110. A second portion 122 of the second MEMS transducing member extends over at least a portion of liquid chamber 310. The second portion 122 of the second MEMS transducing member is free to move relative to liquid chamber 310.

In addition to its configuration relative to the first MEMS transducing member (described above), compliant membrane 320 is similarly positioned in contact with the second MEMS transducing member. A first portion 131 of the compliant membrane covers the second MEMS transducing member and a second portion 132 of compliant membrane 320 is anchored to substrate 110. In FIGS. 20-23B, the first MEMS transducing member is cantilevered beam 120 and the second MEMS transducing member is cantilevered beam 120. The first MEMS transducing member and the second MEMS transducing member are symmetrically positioned relative to orifice 135 of compliant membrane 320.

When MEMS composite transducer 100 includes a plurality of MEMS transducing members, the capabilities of jetting module 305 are increased when compared to jetting modules that do not include a plurality of MEMS transducing members. When so configured, jetting module 305 has the ability to only create (form) liquid drops from the liquid jet ejected through orifice 135 or to create and steer liquid drops from the liquid jet ejected through orifice 135.

Figure 21A:
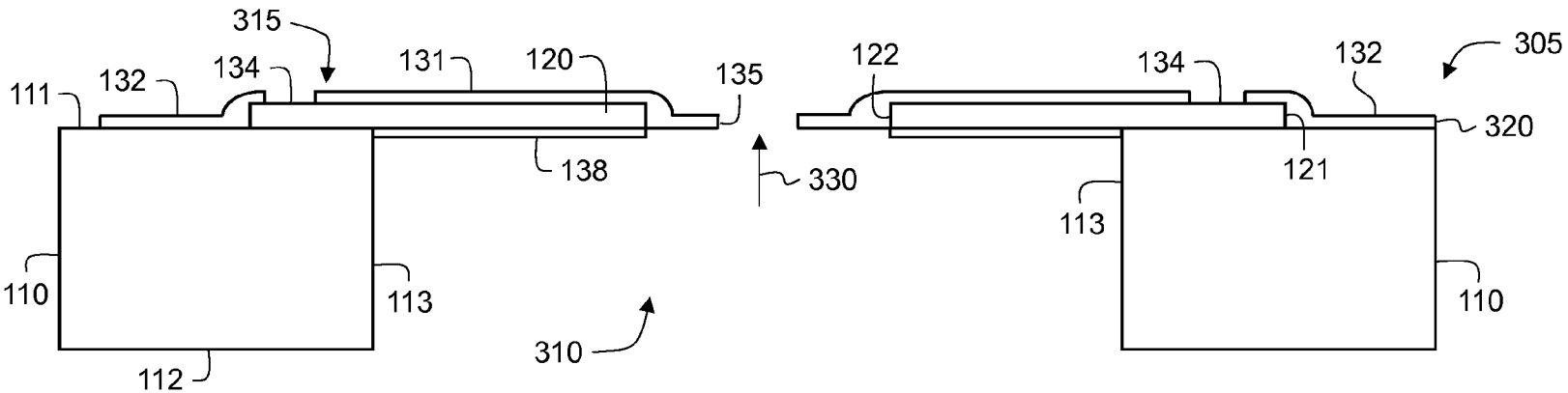
FIG. 21A is a schematic cross-sectional view of the example embodiment shown in FIG. 20.
Figure 21B:
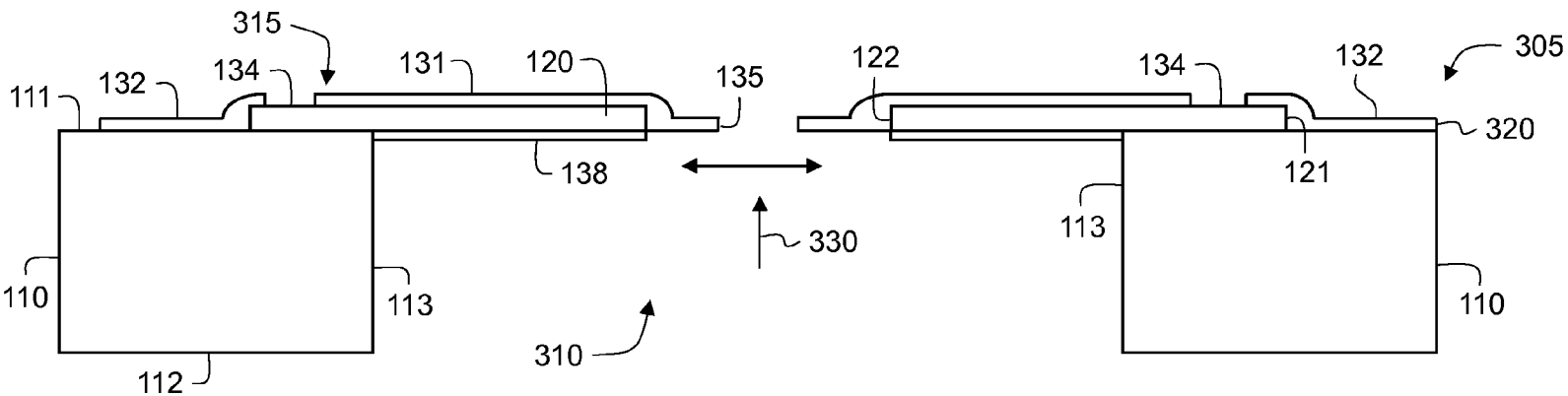
FIG. 21B is a schematic cross-sectional view of the example embodiment shown in FIG. 20 showing in-plane actuation of a drop generator for drop formation.
Figure 21C:
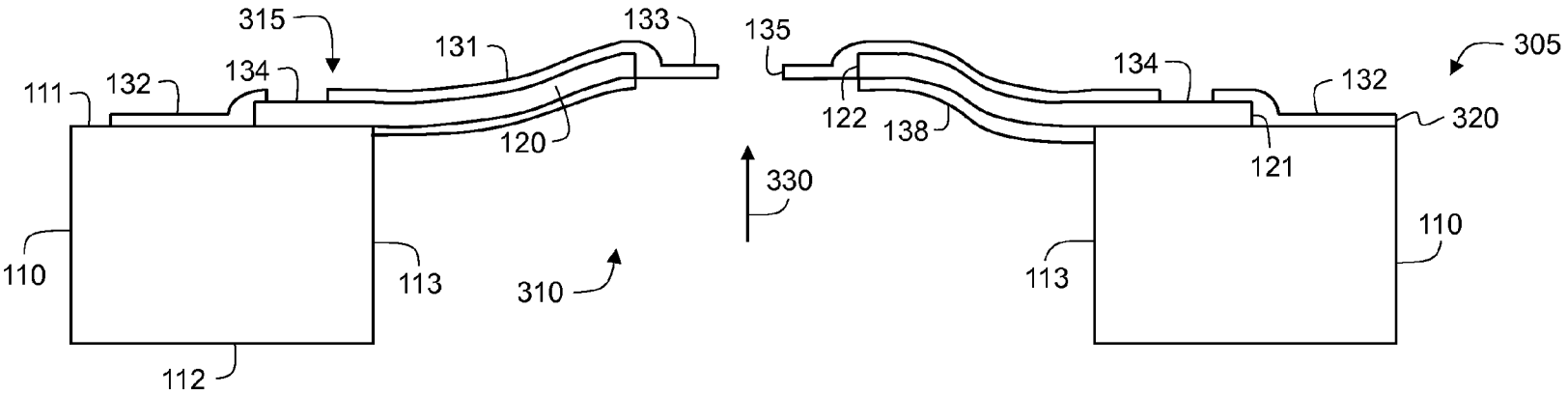
FIG. 21C is a schematic cross-sectional view of the example embodiment shown in FIG. 20 showing out of plane actuation of a drop generator for drop formation.

Referring to FIGS. 21A, 21B, and 21C, when it is desired to only create drops, the plurality of MEMS transducing members of MEMS composite transducer 100, symmetrically positioned relative to orifice 135 of compliant membrane 320, are actuated simultaneously. Simultaneous actuation of the plurality of MEMS transducing members does not alter the trajectory of the liquid jet that is ejected through orifice 135. Typically, the trajectory of the liquid jet is perpendicular to orifice plate 315 when the initial position of orifice plate 315 is in a plane perpendicular to a direction of liquid jet ejection (shown using arrow 330) through orifice 135.

Drop generator 395 is shown at rest in FIG. 21A. Actuation of the plurality of MEMS transducing members is in the same direction either in-plane (shown in FIG. 21B) or out of plane (shown in FIG. 21C) relative to compliant membrane 320. Again, the plane referred to here is the plane in which compliant membrane 320 of orifice plate 315 is initially positioned, for example, a plane perpendicular to a direction of liquid jet ejection (shown using arrow 330) through orifice 135. As with the clamped sheet configuration discussed above, in-plane actuation of the plurality of MEMS transducing members modulates the geometry of orifice 135 causing a liquid drop to break off from the liquid jet. Alternatively, out of plane actuation by expanding or contracting the plurality of MEMS transducing members, having reference materials of appropriate stiffness, results in deflection of compliant membrane 320 (and the. MEMS transducing member) into liquid chamber 310 or out of liquid chamber 310) causing a liquid drop to break off from the liquid jet. The MEMS transducing members 120, are shown at rest in FIG. 21A and actuated in FIG. 21C with deflection of compliant membrane 320 (and the MEMS transducing member) out of liquid chamber 310.

Figure 22:
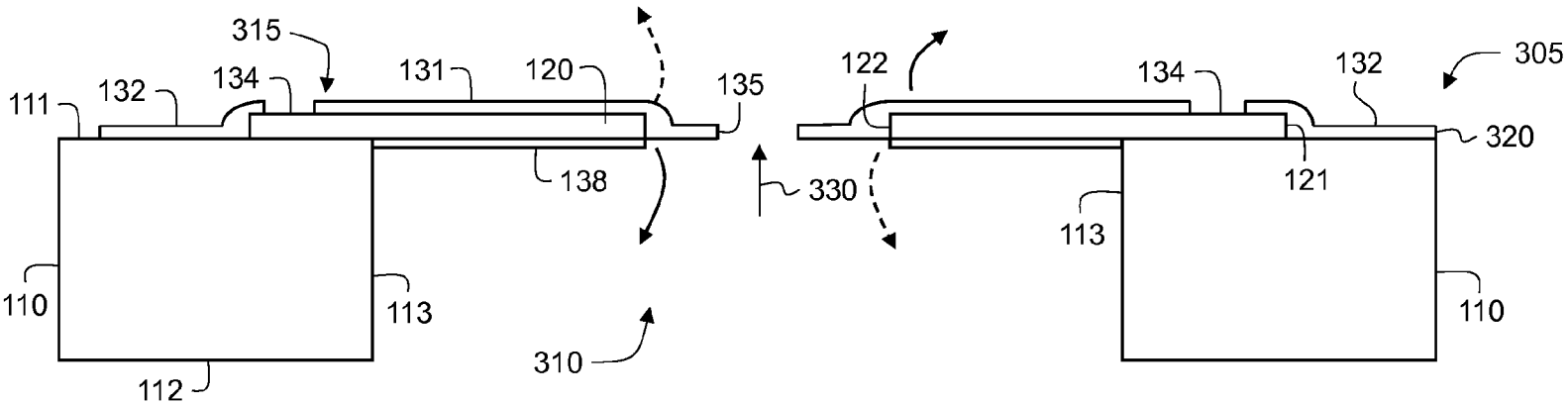
FIG. 22 is a schematic cross-sectional view of an example embodiment of a jetting module showing out of plane actuation of a drop generator for drop formation and drop steering.
Figure 23A:
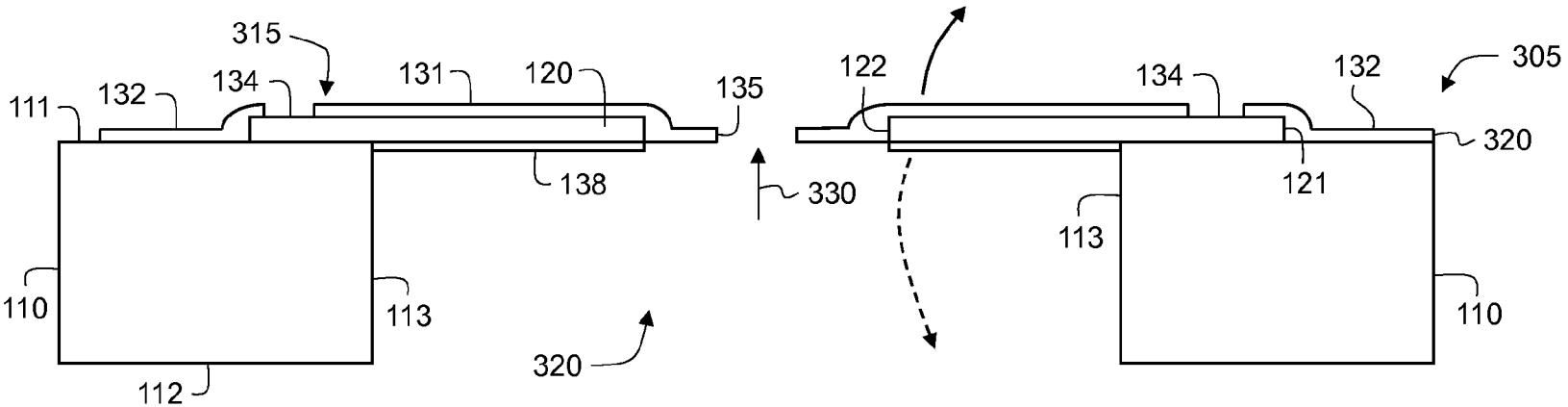
FIG. 23A is a schematic cross-sectional view of another example embodiment of a jetting module showing out of plane actuation of a drop generator for drop formation and drop steering.
Figure 23B:
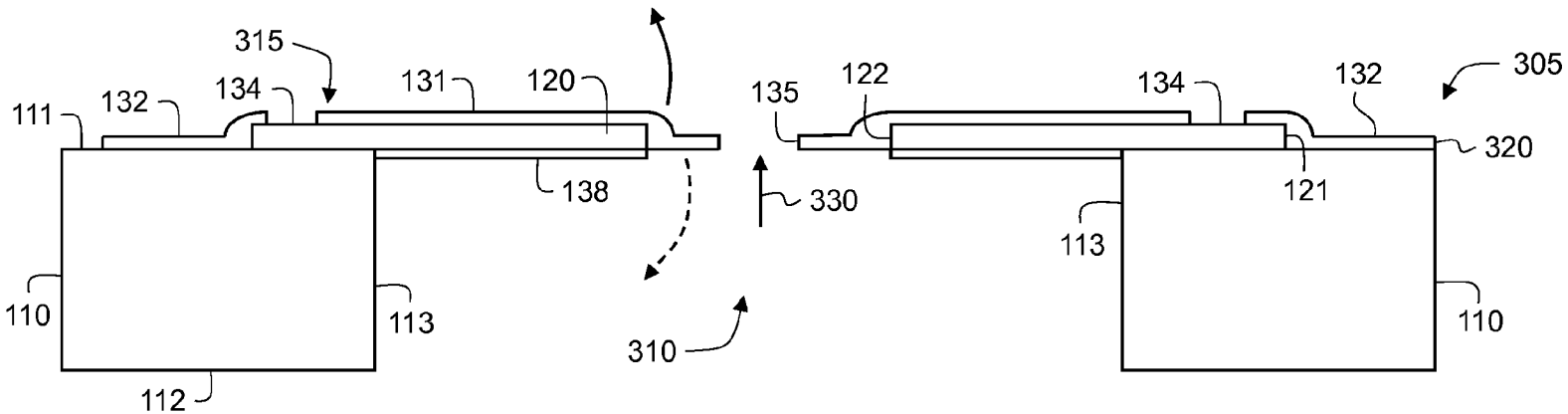
FIG. 23B is a schematic cross-sectional view of another example embodiment of a jetting module showing out of plane actuation of a drop generator for drop formation and drop steering.

Referring to FIGS. 22-23B, when it is desired to create and steer drops, the plurality of MEMS transducing members of MEMS composite transducer 100, symmetrically positioned relative to orifice 135 of compliant membrane 320, are actuated either simultaneously in different, for example, opposite, directions or asynchronously. Actuation of the plurality of MEMS transducing members is out of plane relative to compliant membrane 320. Again, the plane referred to here is the plane in which compliant membrane 320 of orifice plate 315 is initially positioned, for example, a plane perpendicular to a direction of liquid jet ejection (shown using arrow 330) through orifice 135.

Out of plane actuation by expanding or contracting the plurality of MEMS transducing members either simultaneously in different, for example, opposite, directions or asynchronously results in deflection of compliant membrane 320 (and the MEMS transducing member) into liquid chamber 310 or out of liquid chamber 310 which causes the deflection of the ejected liquid jet and causes a liquid drop to break off from the liquid jet. In addition to creating a liquid drop from the liquid jet, the initial trajectory of the ejected liquid jet is altered by the out of plane actuation of the plurality of MEMS transducing members or of one of the plurality of MEMS transducing members.

Typically, the initial trajectory of the liquid jet is perpendicular to orifice plate 315 when the initial position of orifice plate 315 is in a plane perpendicular to a direction of liquid jet ejection (shown using arrow 330) through orifice 135. When, for example, the plurality of MEMS transducing members are actuated simultaneously in opposite directions, the trajectory of the liquid jet is altered such that the trajectory of the liquid jet is at a non-perpendicular angle relative to the initial trajectory of the liquid jet or the initial position of orifice plate 315. The drop that breaks off from the deflected liquid jet travels along the altered trajectory of the liquid jet. In FIG. 22, the pair of solid line arrows illustrates one way to actuate the drop generator and the pair of dashed line arrows illustrates another way to actuate the drop generator. Similar results occur when first MEMS transducing member is actuated asynchronously relative to the second MEMS transducing member. In FIG. 23A, the first MEMS transducing member is actuated by itself either in the direction indicated by the solid line arrow or the direction indicated by the dashed line arrow to achieve drop steering in a first direction. The second MEMS transducing member is actuated by itself either in the direction indicated by the solid line arrow or the direction indicated by the dashed line arrow to achieve drop steering in a second direction. Accordingly, drop steering is effected MEMS composite transducer 100 drop generator of jetting module 305.

The ability to steer drops offers several benefits. For example, drop steering can be used to differentiate between print drops and non-print drops. Alternatively, drop steering can be used to maintain print quality by correcting liquid jets that lack sufficient straightness caused by an accumulation of dust, dirt, or debris on orifice plate 315 or resulting from a manufacturing defect in jetting module 305.

Figure 24A:
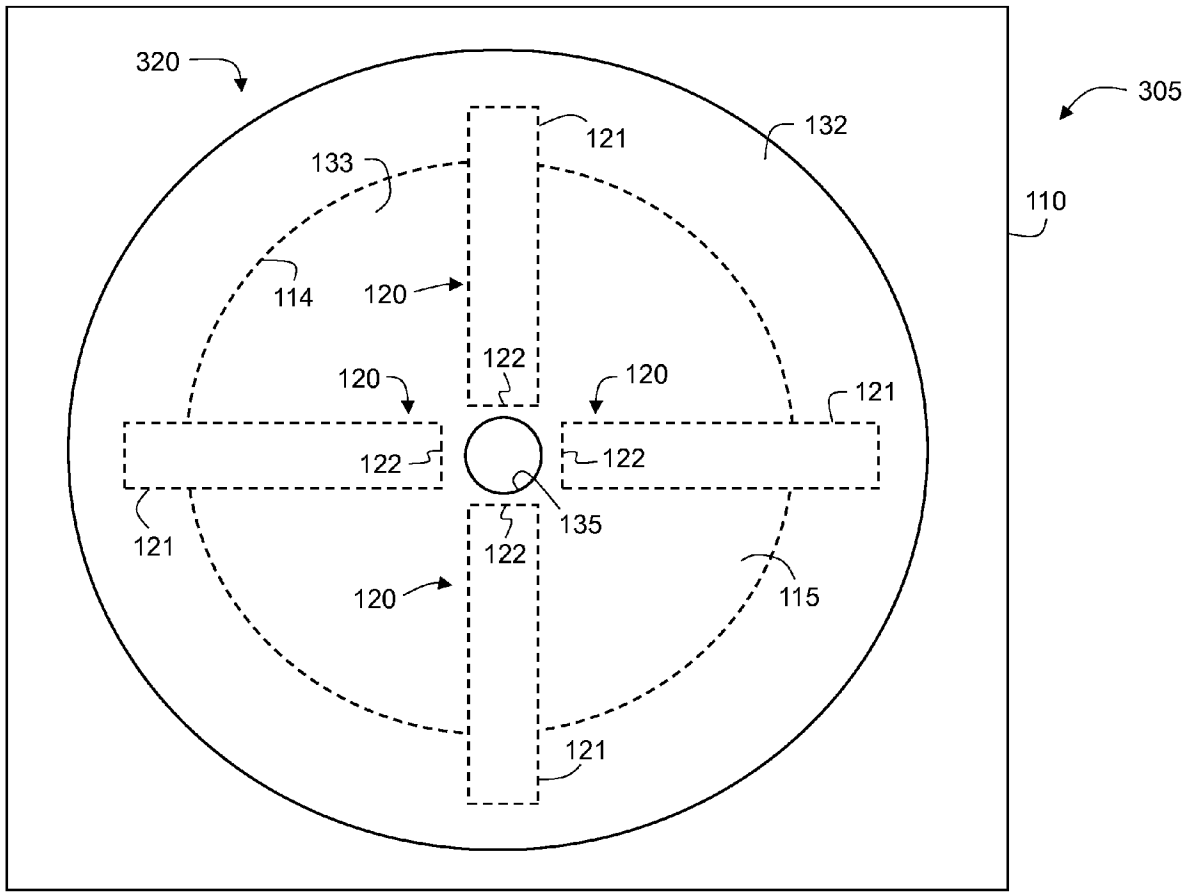
FIG. 24A is a schematic cross-sectional view of another example embodiment of a jetting module showing out of plane actuation of a drop generator for drop formation and increased drop steering control.
Figure 24B:
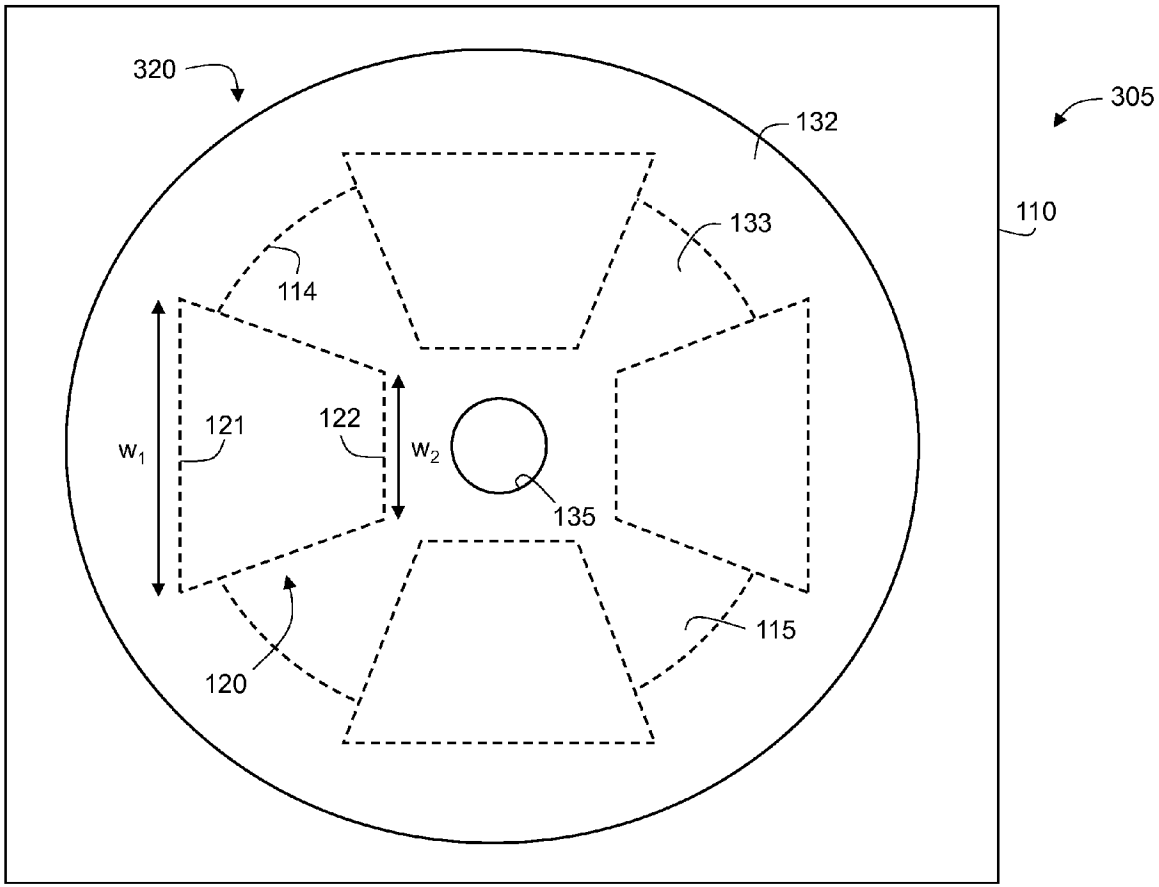
FIG. 24B is a schematic cross-sectional view of another example embodiment of a jetting module showing out of plane actuation of a drop generator for drop formation and increased drop steering control.

Referring to FIGS. 24A and 24B, and back to FIGS. 3 and 4, respectively, positioning additional MEMS transducing members, for example, cantilevered beams 120, symmetrically relative to orifice 135 increases the ability of jetting module 305 to control drop steering. As shown in FIGS. 24A and 24B, four MEMS transducing members are included in orifice plate 315 which provides drop steering in directions along the positioning of each MEMS transducing member as well as in directions between adjacent MEMS transducing members.

Additionally, the frequency response of the jetting module shown in FIG. 24B is increased when compared to the frequency response of the jetting module shown in FIG. 24A because the MEMS transducing members included in the orifice plate shown in FIG. 24B stiffen orifice plate 315 by occupying and contacting a greater area of compliant membrane 320 when compared to occupation and contact area of the MEMS transducing members relative to the compliant membrane 320 shown in FIG. 24A.

The drop that breaks off from the liquid jet, described above, is one of a plurality of drops traveling along a first path. Continuous liquid ejection system 300 includes a deflection mechanism and a catcher. The deflection mechanism is positioned to deflect selected drops of the plurality of drops traveling along the first path such that the selected drops begin traveling along a second path. The catcher is positioned to intercept drops traveling along one of the first path and the second path.

Drops created using these types of drop generators can be are deflected using electrostatic deflection or gas flow deflection. When electrostatic deflection is included in continuous liquid ejection system 300, the deflection mechanism typically includes one electrode or two electrodes. When one electrode is used, the electrode electrically charges and deflects the selected drops such that the deflected drops begin traveling along the second path. When two electrodes are used, a first electrode electrically charges the selected drops and a second electrode deflects the selected drops such that the deflected drops begin traveling along the second path. When gas flow deflection is included in continuous liquid ejection system 300, each drop of the plurality of drops has one of a first size and a second size and the deflection mechanism includes a gas flow that deflects at least the drops having the first size such that the drops having the first size begin traveling along the second path. These aspects of continuous liquid ejection system 300 are described in more detail below with reference to FIGS. 25-30.

Referring to FIGS. 25-27B, an example embodiment of a continuous liquid ejection system 300 that deflects selected drops using electrostatic deflection is shown. Continuous liquid ejection system 300 includes a liquid reservoir 335 that continuously pumps ink to printhead 375 that ultimately creates a continuous stream of liquid, for example, ink, drops.

Continuous liquid ejection system 300 receives digitized image process data from an image source 340, for example, a scanner, digital camera, computer, or other source of digital data which provides raster image data, outline image data in the form of a page description language, or other forms of digital image data. The image data from the image source 340 is sent periodically to an image processor 345. Image processor 345 processes the image data and includes a memory for storing image data. The image processor 345 is typically a raster image processor (RIP). The RIP or other type of image processor 345 converts the image data to a pixel-mapped image page image for printing. Image data in image processor 345 is stored in image memory in the image processor 345 and is sent periodically to a drop or stimulation controller 350 which generates patterns of time-varying electrical stimulation pulses to cause a stream of drops to form liquid jets ejected through each of the nozzle orifices included in jetting module 305. These stimulation pulses are applied at an appropriate time and at an appropriate frequency to drop generator (s) associated with each of the orifices of jetting module 305

Jetting module 305 and deflection mechanism 355 of printhead 375 work in concert with each other in order to determine whether liquid, for example, ink, drops are printed on a recording medium 360 in the appropriate position designated by the data in image memory or deflected and recycled via the liquid recycling units 365. The liquid in the recycling units 365 is directed back into the reservoir 335. The liquid is distributed under pressure through a back surface of jetting module 305 in printhead 375 to a liquid channel in jetting module 305 that includes a chamber or plenum formed in a silicon substrate. Alternatively, the liquid chamber is formed in a manifold piece to which the silicon substrate is affixed. The liquid preferably flows from the chamber through slots or holes etched through the silicon substrate of jetting module 305 to its front surface, where a plurality of orifices and associated drop generators are situated. The liquid pressure suitable for optimal operation depends on a number of factors, including orifice geometry and fluid dynamic properties of the liquid. Constant liquid pressure is achieved by applying pressure to reservoir 335 under the control of a pressure regulator 370.

During a liquid ejection operation, for example, an ink printing operation, a recording medium 360 is moved relative to printhead 375 by a recording medium transport system 380, including a plurality of transport rollers as shown in FIG. 25, which is electronically controlled by a transport control system 385. A logic controller 390, preferably micro-processor based and suitably programmed as is well known, provides control signals for cooperation of transport control system 385 with pressure regulator 370 and stimulation controller 350. The stimulation controller 350 includes a drop controller that provides the drive signals for creating individual liquid drops from printhead 375 that travel to recording medium 360 according to the image data obtained from an image memory forming part of the image processor 345. Image data includes raw image data, additional image data generated from image processing algorithms to improve the quality of printed images, or data from drop placement corrections, which can be generated from many sources, for example, from measurements of the steering errors of liquid ejected through each orifice in jetting module 305 as is well-known to those skilled in the art of printhead characterization and image processing. As such, the information in the image processor 345 is said to represent a general source of data for liquid drop ejection, such as desired locations of ink drops to be printed and identification of those drops to be collected for recycling.

Depending on the application contemplated, different mechanical configurations for receiver transport control are used. For example, when printhead 375 is a page-width printhead 375, it is convenient to move recording medium 360 past a stationary printhead 375. On the other hand, in a scanning-type printing system, it is more convenient to move printhead 375 along one axis (a main-scanning direction) and move the recording medium along an orthogonal axis (a sub-scanning direction), in relative raster motion.

Drop forming pulses are provided by the stimulation controller 350, commonly referred to as drop controller, and are typically voltage pulses sent to printhead 375 through electrical connectors, as is well-known in the art of signal transmission. Once formed, printing drops travel through the air to recording medium 360 and impinge on a particular pixel area of recording medium 360 while non-printing drops are collected by a catcher described below.

Figure 26A:
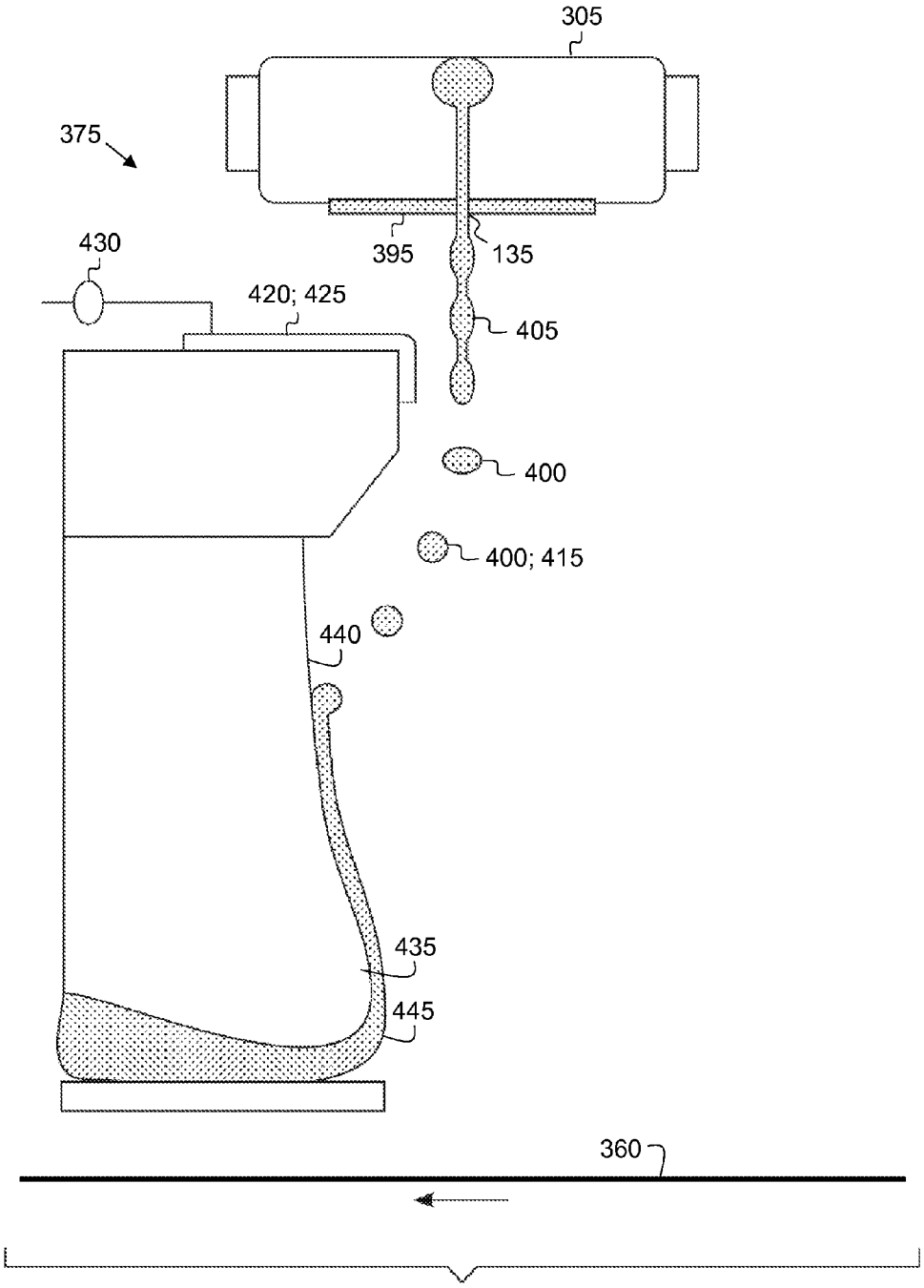
Figure 26B:
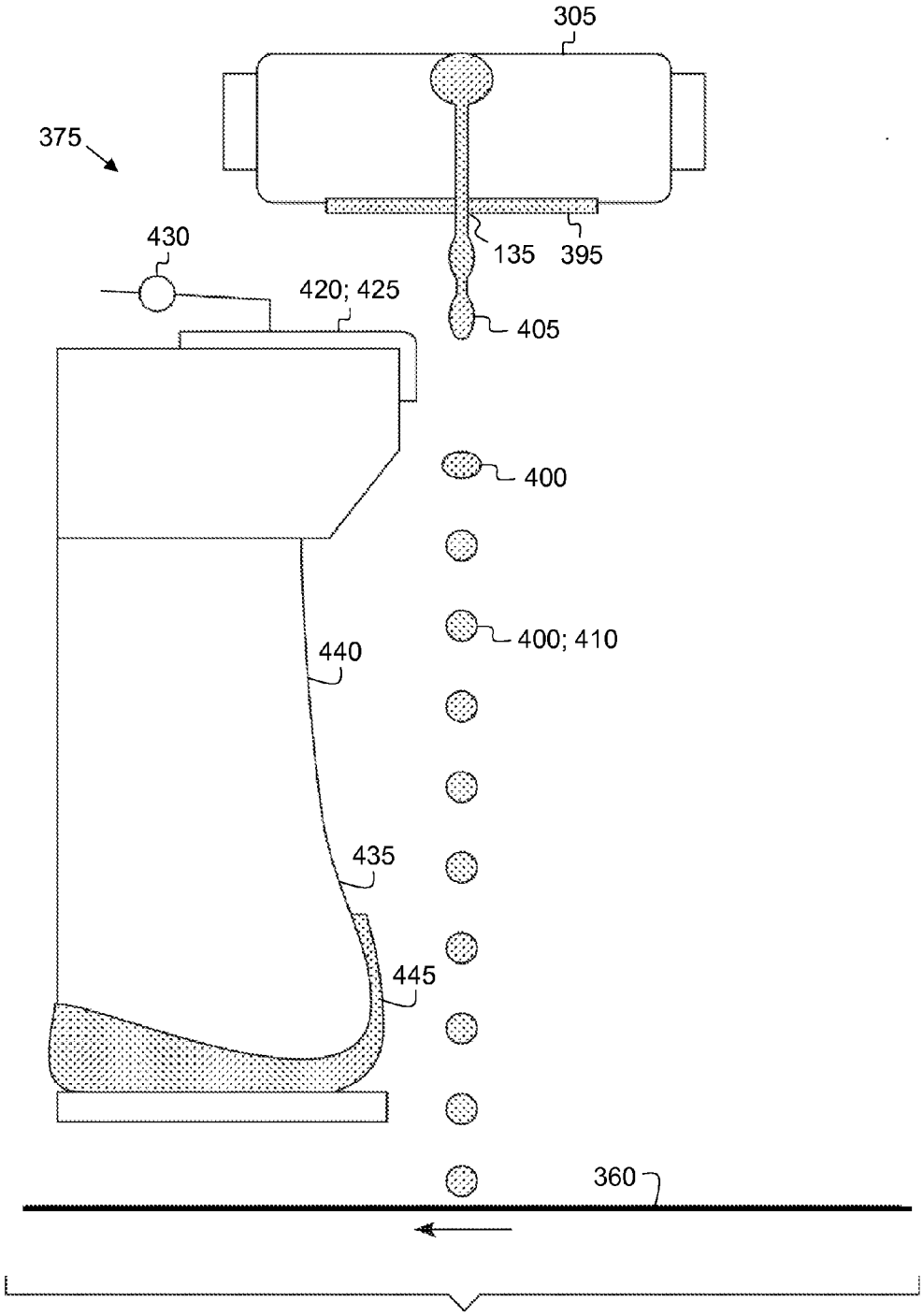

Referring to FIGS. 26A and 26B, a continuous liquid ejection printhead 375 is shown. A drop generator 395 causes liquid drops 400 to break off from a liquid jet 405 ejected through orifice 135. Selection of drops 400 as print drops 410 or non-print drops 415 depends on the phase of the drop break off relative to the charge electrode voltage pulses that are applied to the to a charge electrode 420 that is part of a deflection mechanism 425. The charge electrode 420 is variably biased by a charging pulse source 430 which provides a sequence of charging pulses that is periodic with a fixed frequency.

The charging pulse train preferably includes rectangular voltage pulses having a low level that is grounded relative to the printhead 375 and a high level biased sufficiently to charge the drops 400 as they break off. An exemplary range of values of the electrical potential difference between the high level voltage and the low level voltage is 50 to 200 volts and more preferably 90 to 150 volts.

When a relatively high level voltage or electrical potential is applied to the charge electrode 420 as a drop 400 breaks off from the liquid jet 405 in front of the charge electrode 420 (as shown in FIG. 3A), the drop 400 acquires a charge and is deflected toward a catcher 435. Drops 415 that strike the face 440 of catcher 435 form a liquid film 445 on the face 440 of catcher 435.

Deflection occurs when drops 400; 415 break off the liquid jet 405 while the potential of the charge electrode or electrodes 420 is provided with a voltage or electrical potential having a non-zero magnitude. The drops 400 then acquire an induced electrical charge that remains upon the drop surface. The charge on an individual drop 400 has a polarity opposite that of the charge electrode and a magnitude that is dependent upon the magnitude of the voltage and the capacity of coupling between the charge electrode and the drop 400 at the instant the drop 400 separates from the liquid jet 405. This capacity of coupling is dependent in part on the spacing between the charge electrode 420 and the drop 400 as the drop 400 is breaking off. Once the charged drops 400 have broken away from the liquid jets 405, the drops 400 travel in close proximity to the catcher face 440 which is typically constructed of a conductor or dielectric. The charges on the surface of the drop 400 induce either a surface charge density charge (for the catcher 435 constructed of a conductor) or a polarization density charge (for the catcher 435 constructed of a dielectric). The induced charges in the catcher 435 produce an electric field distribution identical to that produced by a fictitious charge (opposite in polarity and equal in magnitude) located a distance inside the catcher 435 equal to the distance between the catcher 435 and the drop 400. These induced charges in the catcher 435 are known in the art as an image charge. The force exerted on the charged drop 400 by the catcher face 440 is equal to what would be produced by the image charge alone and causes the charged drops 400 to deflect and thus diverge from its path and accelerate along a trajectory toward the catcher face 440 at a rate proportional to the square of the drop charge and inversely proportional to the drop mass. In this embodiment, the charge distribution induced on the catcher 435 makes up a portion of the deflection mechanism 425. In other embodiments, the deflection mechanism 425 includes one or more additional electrodes to generate an electric field through which the charged drops pass so as to deflect the charged drops. For example, a single biased electrode in front of the upper grounded portion of the catcher is used and described in U.S. Pat. No. 4,245,226. A pair of additional electrodes are used and described in U.S. Pat. No. 6,273,559

Referring to FIG. 26B, when the break off point of drop 400 from liquid jet 405 occurs when the electrical potential of the charge electrode 420 is at a relatively low level or zero, the drop 400; 410 does not acquire a charge. Drop 400; 410 travels along a trajectory which is typically an undeflected path and impacts recording medium 360.

Figure 27A:
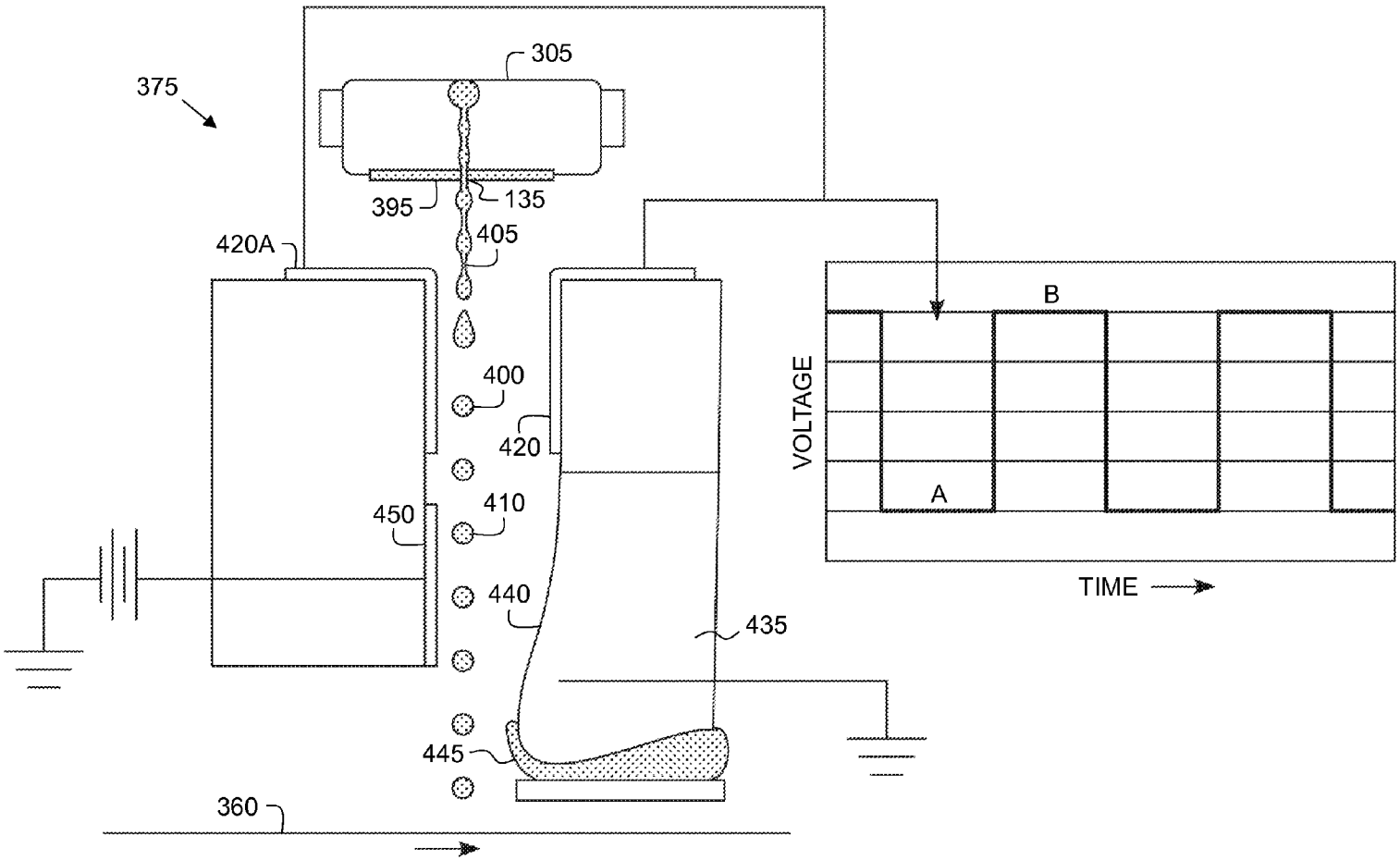
Figure 27B:
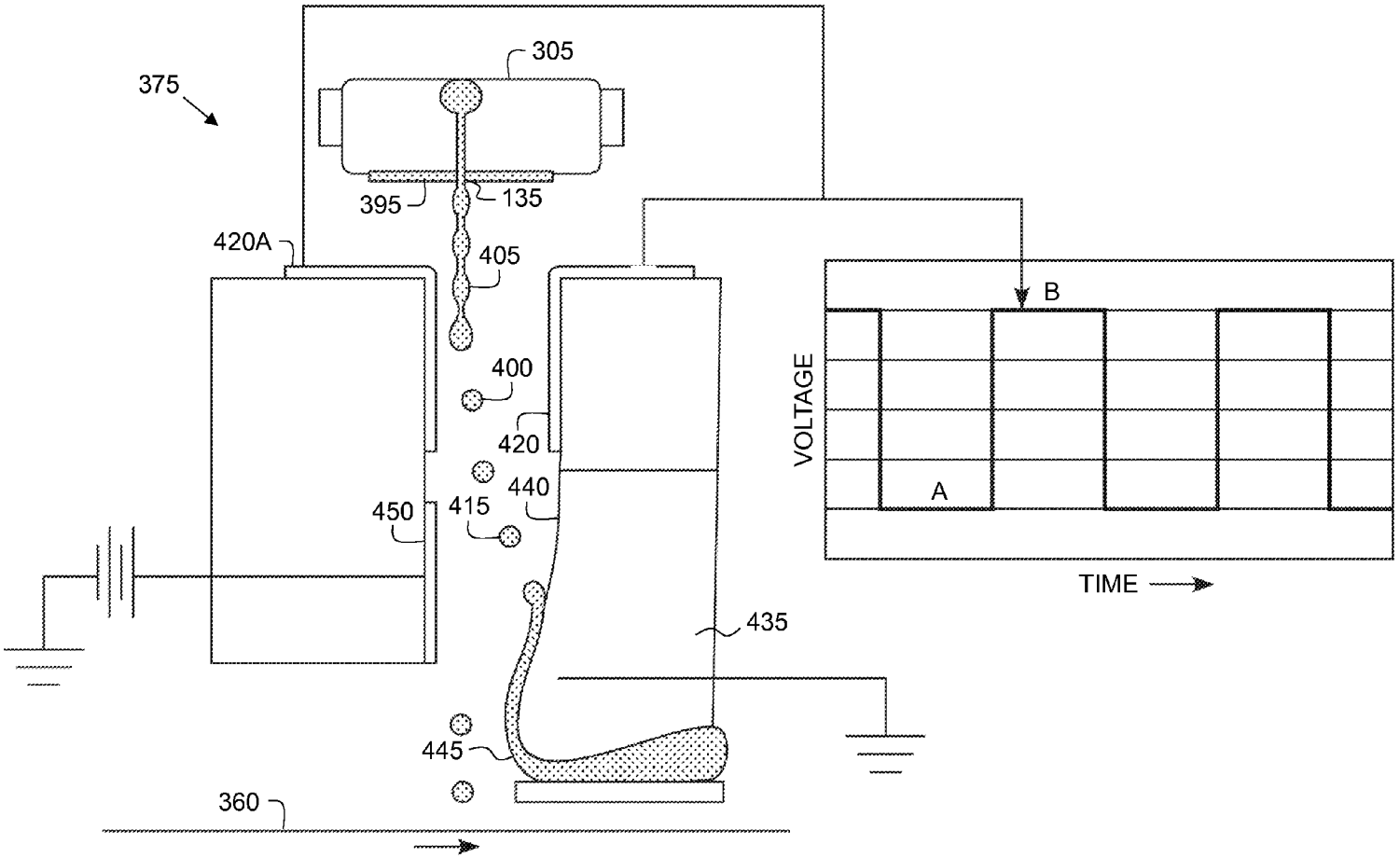

Referring to FIGS. 27A and 27B, a printhead 375 similar to that described with reference to FIGS. 26A and 26B is shown. In this embodiment, however, the deflection mechanism 425 also includes a second charge electrode 420A located on the opposite side of the jet array 405 from the (first) charge electrode 420. Second charge electrode 420A receives the same charging pulses from the charge pulse source 430 as first charge electrode 420 and is constantly held at the same potential as first charge electrode 420. The addition of a second charge electrode 420A biased to the same potential as first charge electrode 420 produces a region between the charging electrodes 420 and 420A with a very uniform electric field. Placement of the drop breakoff points between these charge electrodes makes the drop charging and subsequent drop deflection very insensitive to the small changes in breakoff position relative to the charging electrodes or to the small changes in the electrode geometries. This configuration is therefore much more suitable for use with printheads 375 having long arrays of orifices 135.

The deflection mechanism 425 also includes a deflection electrode 450. The voltage potential between the biased deflection electrode 450 and the catcher face 440 produces an electric field through which the drops 400 must pass. Charged non-print drops 415 are deflected by this electric field and strike the catcher face 440. FIGS. 27A and 27B also show a graph illustrating the voltage or electrical potential on the charge electrode 420 and second charge electrode 420A at the respective times when a drop 400 breaks off. The periodicity of the electrical potential on the charge electrode 420 and 420A is synchronized with the pulse stimulation signals provided to the drop generator 395 located at each orifice 135.

Alternatively, electrostatic deflection can be accomplished using individual charging electrodes with one electrode being associated with a corresponding one of the orifices 135 of the orifice array. The individually associated electrodes can charge and deflect selected drops either alone, as described above with reference to FIGS. 26A and 26B, or in combination with separate deflection electrodes, as described above with reference to FIGS. 27A and 27B. These types of electrostatic deflection systems have been described in U.S. Pat. No. 7,273, 270, issued on Sep. 25, 2007, to Katerberg; and in U.S. Pat. No. 7,673,976, issued on Mar. 9, 2010, to Piatt et al.

Figure 29:
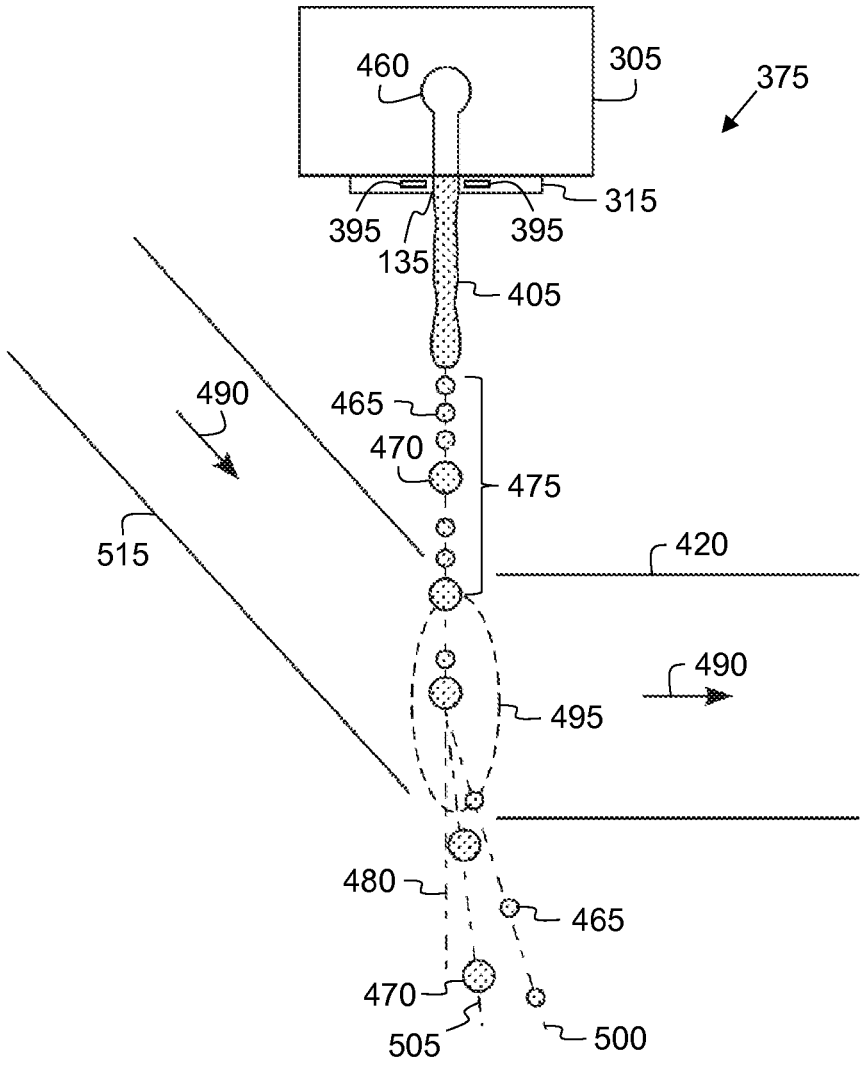
Figure 30:
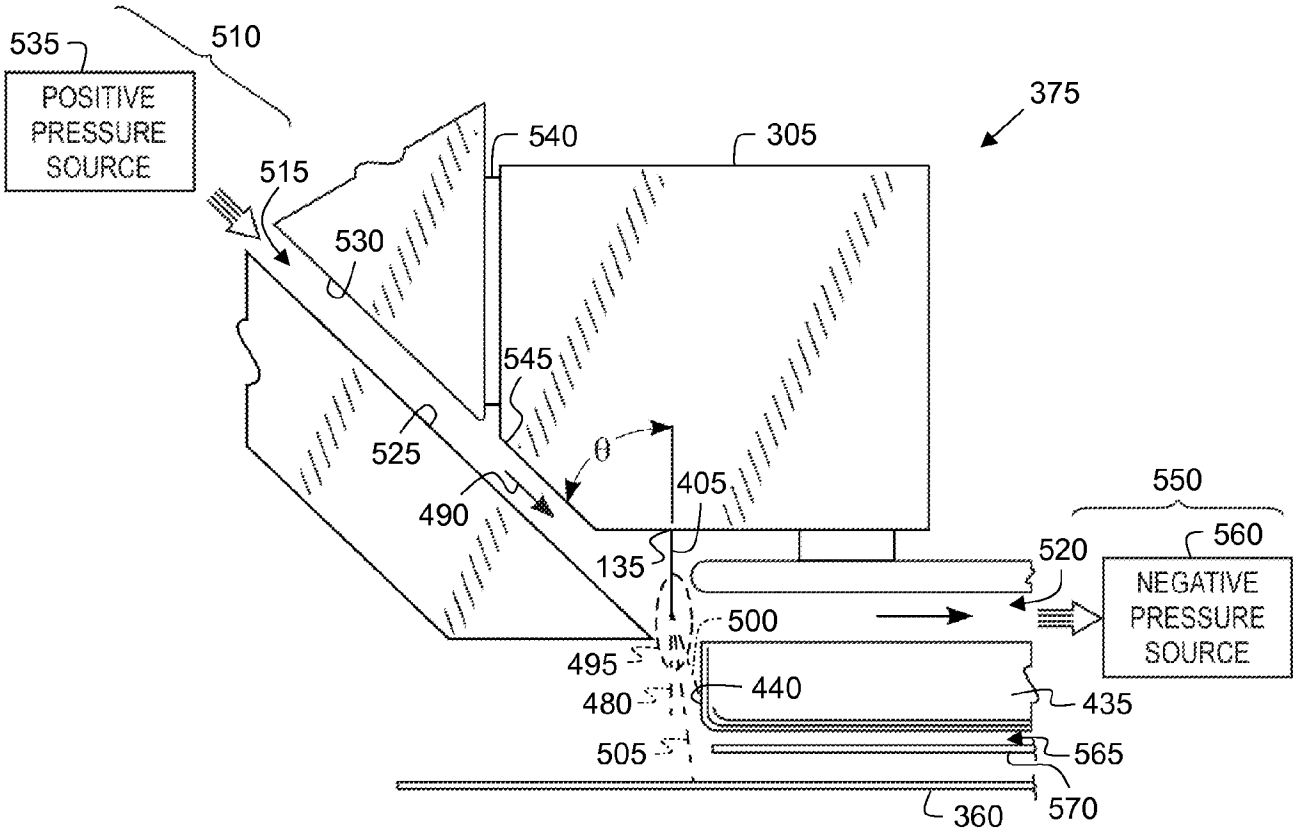

Referring to FIGS. 28-30, an example embodiment of a continuous liquid ejection system 300 that deflects drops using gas flow deflection is shown. Continuous liquid ejection system 300 includes an image source 340, for example, a scanner or computer which provides raster image data, outline image data in the form of a page description language, or other forms of digital image data. The image data is converted to half-toned bitmap image data by an image processing unit 345 which also stores the image data in memory. A plurality of control circuits 455 read data from the image memory and applies time-varying electrical pulses to a drop generators 395 each associated with an orifice of printhead 375. The pulses are applied at an appropriate time, and to the appropriate drop generator 395, so that drops that break off from a continuous liquid jet form spots on recording medium 360 in the appropriate position designated by the data in the image memory.

Recording medium 360 is moved relative to printhead 375 by a recording medium transport system 380, which is electronically controlled by a recording medium transport control system 385 which is controlled by a micro-controller 390. The recording medium transport system 380 shown in FIG. 28 is a schematic only, and many different mechanical configurations are possible. For example, a transfer roller is used in some applications as recording medium transport system 380 to facilitate transfer of drops to recording medium 360. Such transfer roller technology is well known in the art. When printhead 375 is a page width printheads 375, it is most convenient to move recording medium 360 past a stationary printhead. However, when printhead 375 is a scanning type printhead, it is usually most convenient to move printhead 375 along one axis (the main scanning direction) and recording medium 360 along an orthogonal axis (the sub-scanning direction) in a relative raster motion.

Liquid, for example, ink, is contained in a liquid supply 335 under pressure. In the non-printing state, continuous liquid drop streams are unable to reach recording medium 360 due to a catcher 435 that collects the drops for recycling by a recycling unit 365. Recycling unit 365 reconditions the liquid and feeds it back to reservoir 335. Such recycling units are well known in the art. The liquid pressure suitable for optimal operation depends on a number of factors, including orifice geometry and properties of the liquid. A constant liquid pressure is achieved by applying pressure to reservoir 335 under the control of liquid pressure regulator 370. Alternatively, the reservoir 335 can be left unpressurized, or even under a reduced pressure (vacuum), while a pump is used to deliver liquid from reservoir 335 under pressure to printhead 375. In this example embodiment, pressure regulator 370 typically includes a liquid pump control system. As shown in FIG. 28, catcher 435 is a type of catcher commonly referred to as a "knife edge" catcher.

Liquid is distributed through a back surface of printhead 375 through a liquid channel 460 located in jetting module 305. The liquid preferably flows through slots or holes etched through a silicon substrate of printhead 375 to its front surface, where a plurality of orifices and associated drop generators are situated. When printhead 375 is fabricated from silicon, drop generator control circuits 455 can be integrated with printhead 375. Printhead 375 also includes a deflection mechanism which is described in more detail below with reference to FIGS. 29 and 30.

Referring to FIG. 29, a schematic view of a continuous liquid ejection printhead 375 is shown. A jetting module 305 of printhead 375 includes an array or a plurality of nozzles orifices 135 formed in an orifice plate 315. In FIG. 29, nozzle plate 315 is affixed to jetting module 305. However, as shown in FIG. 30, nozzle plate 315 is an integral portion of jetting module 305. Liquid, for example, ink, is ejected under pressure through each orifice 135 of the array to form jets 405 of liquid. In FIG. 29, the array or plurality of orifices 135 extends into and out of the figure.

The plurality of control circuits 455 read data from the image memory and apply time-varying electrical pulses to each drop generator 395 to form liquid drops 400 having a first size (or volume) 465 and liquid drops having a second size (or volume) 470 from each liquid jet. To accomplish this, jetting module 305 includes a drop generator (or drop forming device) 395, described above, that, when activated, perturbs each jet 405 of liquid, for example, ink, to induce portions of each jet to breakoff from the jet and coalesce to form drops 465 and 470. One drop generator 395 is associated with each orifice 135 of the orifice array. The application of time-varying electrical pulses to each drop generator 395 using control circuits 455 is known with certain aspects having been described in, for example, one or more of U.S. Pat. No. 6,491,362 B1, issued to Jeanmaire, on Dec. 10, 2002; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; and U.S. Pat. No. 6,851,796 B2, issued to Jeanmaire et al., on Feb. 8, 2005.

When printhead 375 is in operation, drops 465, 470 are created in a plurality of sizes or volumes, for example, drops having a first size or volume (small drops) 465 and drops having a second size or volume (large drops)470. The ratio of the mass of the large drops 470 to the mass of the small drops 465 is typically an integer between 2 and 10. A drop stream 475 including drops 465 and 470 travels along a drop path or trajectory 480.

Printhead 375 also includes a gas flow deflection mechanism 485 that directs a flow of gas 490, for example, air, through gas flow ducts 515, 520 and past a portion of the drop trajectory 480 commonly referred to as a deflection zone 495. As the flow of gas 490 interacts with drops 465, 470 in deflection zone 495 it alters the drop trajectories. As the drops 465, 470 pass out of the deflection zone 495 they are traveling at an altered trajectory that is at an angle, often referred to as a deflection angle, relative to the undeflected drop trajectory 480.

Small drops 465 are more affected by the flow of gas than are large drops 470 so that the resulting small drop trajectory 500 diverges from the large drop trajectory 505. That is, the deflection angle for small drops 465 is larger than for large drops 470. The flow of gas 490 provides sufficient drop deflection and therefore causes sufficient divergence of the small and large drop trajectories so that catcher 435 (shown in FIGS. 28 and 30), positioned to intercept drops traveling along one of the small drop trajectory 500 and the large drop trajectory 505, collects drops traveling along one of the trajectories while allowing drops following the other trajectory to impinge recording medium 360 (shown in FIGS. 28 and 30).

Referring to FIG. 30, a positive pressure gas flow structure 510 of gas flow deflection mechanism 485 is located on a first side of drop trajectory 480. Positive pressure gas flow structure 510 includes a first gas flow duct 515 that includes a lower wall 525 and an upper wall 530. Gas flow duct 515 directs gas flow 490 supplied from a positive pressure source 535 at downward angle 0 of approximately a 45° relative to liquid jet 405 toward drop deflection zone 495 (shown in FIG. 2). An optional seal(s) 540 provides a fluid seal between jetting module 305 and upper wall 530 of gas flow duct 515.

Upper wall 530 of gas flow duct 515 does not need to extend to drop deflection zone 495 (as shown in FIG. 29). In FIG. 30, upper wall 530 ends at a wall 545 of jetting module 305. Wall 545 of jetting module 305 serves as a portion of upper wall 530 ending at drop deflection zone 495.

Negative pressure gas flow structure 550 of gas flow deflection mechanism 485 is located on a second side of drop trajectory 480. Negative pressure gas flow structure 550 includes a second gas flow duct 520 located between catcher 435 and an upper wall 555 that exhausts gas flow from deflection zone 495. Second duct 520 is connected to a negative pressure source 560 that is used to help remove gas flowing through second duct 520. An optional seal(s) 540 provides a fluid seal between jetting module 305 and upper wall 555.

As shown in FIG. 30, gas flow deflection mechanism 485 includes positive pressure source 535 and negative pressure source 560. However, depending on the specific application contemplated, gas flow deflection mechanism 485 includes only one of positive pressure source 535 and negative pressure source 560.

In operation, gas supplied by first gas flow duct 515 is directed into drop deflection zone 495, where it causes large drops 470 to follow large drop trajectory 505 and small drops 465 to follow small drop trajectory 500. As shown in FIG. 3, drops 465 traveling along small drop trajectory 500 are intercepted by a front face 440 of catcher 435. Small drops 465 contact face 440 and flow down face 440 and into a liquid return duct 565 located or formed between catcher 435 and a plate 570. Collected liquid is either recycled and returned to reservoir 335 (shown in FIG. 1) for reuse or discarded. Large drops 470 bypass catcher 435 and travel to recording medium 360. Alternatively, catcher 435 can be positioned to intercept drops 470 traveling along large drop trajectory 505. Large drops 470 contact catcher 435 and flow into liquid return duct 565 located or formed in catcher 435. Collected liquid is either recycled for reuse or discarded. Small drops 465 bypass catcher 435 and travel to recording medium 360.

As shown in FIG. 30, catcher 435 is a type of catcher commonly referred to as a "Coanda" catcher. However, the "knife edge" catcher shown in FIG. 28 and the "Coanda" catcher shown in FIG. 30 are interchangeable and either can be used with the selection typically depending on the application contemplated. Alternatively, catcher 435 can be of any suitable design including, but not limited to, a porous face catcher, a delimited edge catcher, or combinations of any of those described above.

Figure 31:
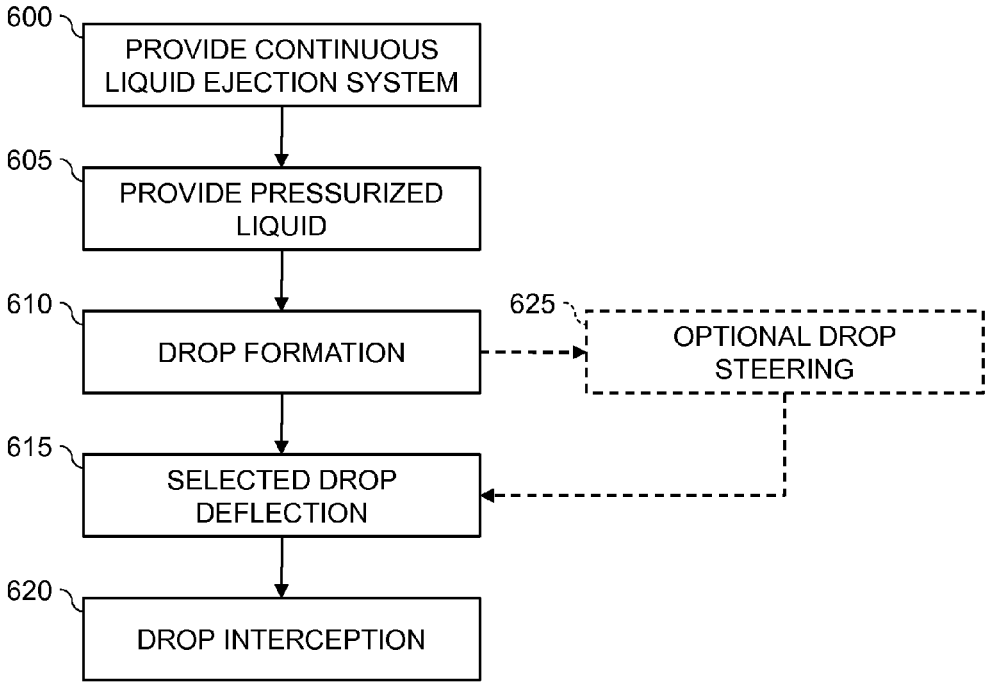
FIG. 31 shows a block diagram describing an example embodiment of a method of continuously ejecting liquid using the continuous liquid ejection system described herein.

Referring to FIG. 31, an example embodiment of a method of continuously ejecting liquid using the continuous liquid ejection system described above is shown. The method begins with step 600.

In step 600, a continuous liquid ejection system is provided. The system includes a substrate and an orifice plate affixed to the substrate. Portions of the substrate define a liquid chamber. The orifice plate includes a MEMS transducing member. A first portion of the MEMS transducing member is anchored to the substrate. A second portion of the MEMS transducing member extends over at least a portion of the liquid chamber. The second portion of the MEMS transducing member is free to move relative to the liquid chamber. A compliant membrane is positioned in contact with the MEMS transducing member. A first portion of the compliant membrane covers the MEMS transducing member and a second portion of the compliant membrane is anchored to the substrate. The compliant membrane includes an orifice. Step 600 is followed by step 605. Typically, the compliant membrane is a compliant polymeric membrane made from one of the polymers described above. However, compliant membrane can be any of the compliant membranes described above depending on the specific application contemplated.

In step 605, a liquid is provided under a pressure sufficient to eject a continuous jet of the liquid through the orifice located in the compliant membrane of the orifice plate by a liquid supply. Step 605 is followed by step 610.

In step 610, a drop of liquid is caused to break off from the liquid jet by selectively actuating the MEMS transducing member which causes a portion of the compliant membrane to be displaced relative to the liquid chamber. Step 610 is followed by step 615 and step 625.

In step 625, optionally, the formed drop is steered by the MEMS transducing member. Step 625 is followed by step 615.

In step 615, the drop is one of a plurality of drops traveling along a first path. An appropriately positioned deflection mechanism deflects selected drops of the plurality of drops traveling along the first path such that the selected drops begin traveling along a second path. Step 615 is followed by step 620.

In step 620, an appropriately positioned catcher intercepts drops traveling along one of the first path and the second path.

The invention has been described in detail with particular reference to certain preferred embodiments thereof, but it will be understood that variations and modifications can be effected within the scope of the invention.

PARTS LIST

100 MEMS composite transducer
110 substrate
111 first surface of substrate
112 second surface of substrate
113 portions of substrate (defining outer boundary of cavity)
114 outer boundary
115 cavity
116 through hole (fluid inlet)
118 mass
120 cantilevered beam
121 anchored end (of cantilevered beam)
122 cantilevered end (of cantilevered beam)
130 compliant membrane
131 covering portion of compliant membrane
132 anchoring portion of compliant membrane
133 portion of compliant membrane overhanging cavity
134 portion where compliant membrane is removed
135 hole (in compliant membrane), orifice
138 compliant passivation material
140 doubly anchored beam
141 first anchored end
142 second anchored end
143 intersection region
150 clamped sheet
151 outer boundary (of clamped sheet)
152 inner boundary (of clamped sheet)
160 MEMS transducing material
162 reference material
163 first layer (of reference material)
164 second layer (of reference material)
165 third layer (of reference material)
166 bottom electrode layer
167 seed layer
168 top electrode layer
171 first region (where transducing material is retained)
172 second region (where transducing material is removed)
200 fluid ejector
201 chamber
202 partitioning walls
204 nozzle plate
205 nozzle
300 continuous liquid ejection system
305 jetting module
310 liquid chamber
315 orifice plate
320 compliant membrane
325 liquid supply
330 liquid ejection arrow
335 liquid reservoir
340 image source
345 image processor
350 stimulation controller
355 deflection mechanism
360 recording medium
365 liquid recycling units
370 pressure regulator
375 printhead
380 recording medium transport system
385 recording medium transport control system
390 logic controller
395 drop generator
400 liquid drops
405 liquid jet
410 print drops
415 non-print drops
420 charge electrode
420A second charge electrode
425 deflection mechanism
430 charging pulse source
435 catcher
440 face
445 liquid film
450 deflection electrode
455 plurality of control circuits
460 liquid channel
465 drops
470 drops
475 drop stream
480 trajectory
485 gas flow deflection mechanism
490 gas flow
495 deflection zone
500 small drop trajectory
505 large drop trajectory
510 positive pressure gas flow structure
515 gas flow ducts
520 gas flow ducts
525 lower wall
530 upper wall
535 positive pressure source
545 wall
550 negative pressure gas flow structure
555 upper wall
560 negative pressure source
565 liquid return duct
570 plate
600 provide continuous liquid ejection system
605 provide pressurized liquid
610 drop formation
615 selected drop deflection
620 drop interception
625 optional drop steering

The invention claimed is:

1. A method of continuously ejecting liquid comprising:

providing a continuous liquid ejection system including:

a substrate, portions of the substrate defining a liquid chamber;

an orifice plate affixed to the substrate, the orifice plate including:

a MEMS transducing member, a first portion of the MEMS transducing member being anchored to the substrate, a second portion of the MEMS transducing member extending over at least a portion of the liquid chamber, the second portion of the MEMS transducing member being free to move relative to the liquid chamber; and a compliant membrane positioned in contact with the MEMS transducing member, a first portion of the compliant membrane covering the MEMS transducing member such that the first portion of the MEMS transducing member is positioned between the substrate and the compliant membrane, and a second portion of the compliant membrane being anchored to the substrate, the compliant membrane including an orifice;

providing a liquid under a pressure sufficient to eject a continuous jet of the liquid through the orifice located in the compliant membrane of the orifice plate using a liquid supply; and causing a drop of liquid to break off from the liquid jet by selectively actuating the MEMS transducing member causing a portion of the compliant membrane to be displaced relative to the liquid chamber.

2. The method of claim 1, the compliant membrane being positioned in a plane, wherein selectively actuating the MEMS transducing member includes actuating the MEMS transducing member such that at least a portion of the MEMS composite transducer moves in the plane of the compliant membrane.

3. The method of claim 2, the MEMS transducing member encircling the orifice, wherein actuating the MEMS transducing member modulates the geometry of the orifice.

4. The method of claim 1, the compliant membrane being positioned in a plane, wherein selectively actuating the MEMS transducing member includes actuating the MEMS transducing member such that at least a portion of the MEMS composite transducer moves out of the plane of the compliant membrane.

5. The method of claim 1, the MEMS transducing member being a first MEMS transducing member, the orifice plate including:

a second MEMS transducing member, a first portion of the second MEMS transducing member being anchored to the substrate, a second portion of the second MEMS transducing member extending over at least a portion of the liquid chamber, the second portion of the second MEMS transducing member being free to move relative to the liquid chamber, the compliant membrane positioned in contact with the second MEMS transducing member, a first portion of the compliant membrane covering the second MEMS transducing member, and a second portion of the compliant membrane being anchored to the substrate.

6. The method of claim 5, wherein the first MEMS transducing member and the second MEMS transducing member are symmetrically positioned relative to the orifice of the compliant membrane.

7. The method of claim 6, the compliant membrane positioned in a plane, the method further comprising:

selectively actuating the first MEMS transducing member and selectively actuating the second MEMS transducing member simultaneously in the plane of the compliant membrane.

8. The method of claim 6, the compliant membrane positioned in a plane, the method further comprising:

selectively actuating the first MEMS transducing member and selectively actuating the second MEMS transducing member simultaneously out of the plane of the compliant membrane.

9. The method of claim 8, wherein actuating the first MEMS transducing member and selectively actuating the second MEMS transducing member simultaneously includes actuating the first MEMS transducing member and the second MEMS transducing member simultaneously in the same direction.

10. The method of claim 8, wherein actuating the first MEMS transducing member and selectively actuating the second MEMS transducing member simultaneously further comprises causing steering of the drop that breaks off from the liquid jet by actuating the first MEMS transducing member and the second MEMS transducing member simultaneously in opposite directions.

11. The method of claim 6, the compliant membrane positioned in a plane, the method further comprising:

causing steering of the drop that breaks off from the liquid jet by selectively actuating one of the first MEMS transducing member and the second MEMS transducing member out of the plane of the compliant membrane.

12. The method of claim 1, the drop being one of a plurality of drops traveling along a first path, the method further comprising:

providing a deflection mechanism; and deflecting selected drops of the plurality of drops traveling along the first path such that the selected drops begin traveling along a second path using the deflection mechanism.

13. The method of claim 12, wherein deflecting selected drops of the plurality of drops traveling along the first path includes electrically charging and deflecting the selected drops using a single electrode such that the deflected drops begin traveling along the second path.

14. The method of claim 12, wherein deflecting selected drops of the plurality of drops traveling along the first path includes electrically charging the selected drops using a first electrode and deflecting the selected drops using a second electrode such that the deflected drops begin traveling along the second path.

15. The method of claim 12, each drop of the plurality of drops having one of a first size and a second size, wherein deflecting selected drops of the plurality of drops traveling along the first path includes deflecting at least the drops having the first size using a gas flow such that the drops having the first size begin traveling along the second path.

16. The method of claim 12, further comprising:

intercepting drops traveling along one of the first path and the second path using a catcher.

17. The method of claim 1, wherein selectively actuating the MEMS transducing member also causes steering of the drop that breaks off from the liquid jet.

18. The method of claim 1, wherein the compliant membrane is a compliant polymeric membrane.

19. The method of claim 1, wherein the MEMS transducing member has a Young's modulus that is at least a factor of 10 greater than a Young's modulus of the compliant membrane.

* * * * *